US009943200B2

(12) United States Patent
Qian

(10) Patent No.: US 9,943,200 B2
(45) Date of Patent: Apr. 17, 2018

(54) SYSTEM AND METHOD TO STORE AN ELECTRIC HOSE IN A CENTRAL VACUUM SYSTEM

(71) Applicant: PLASTIFLEX GROUP NV, Paal-Beringen (BE)

(72) Inventor: Jiong Qian, Chapel Hill, NC (US)

(73) Assignee: Plastiflex Group NV, Paal-Beringen (BE)

( * ) Notice: Subject to any disclaimer, the term of this patent is extended or adjusted under 35 U.S.C. 154(b) by 502 days.

(21) Appl. No.: 14/660,881

(22) Filed: Mar. 17, 2015

(65) Prior Publication Data

US 2015/0257615 A1 Sep. 17, 2015

Related U.S. Application Data

(60) Provisional application No. 61/954,526, filed on Mar. 17, 2014.

(51) Int. Cl.

| | |
|---|---|
| ***A47L 5/38*** | (2006.01) |
| ***A47L 9/24*** | (2006.01) |
| ***A47L 9/00*** | (2006.01) |

(52) U.S. Cl.

CPC ..... *A47L 5/38* (2013.01); *A47L 9/0063* (2013.01); *A47L 9/244* (2013.01); *A47L 9/248* (2013.01); *Y10T 137/0441* (2015.04); *Y10T 137/698* (2015.04); *Y10T 137/6918* (2015.04)

(58) Field of Classification Search

CPC ..... A47L 5/38; A47L 9/24–9/248

See application file for complete search history.

(56) References Cited

U.S. PATENT DOCUMENTS 5,526,842 A * 6/1996 Christensen ..... A47L 5/38 137/355.16

2007/0174991 A1* 8/2007 Trotter ..... A47L 5/38 15/314

* cited by examiner

*Primary Examiner* — Andrew A Horton

(74) *Attorney, Agent, or Firm* — Womble Bond Dickinson (US) LLP

(57) ABSTRACT

A hose storage system and method for an electric hose for use in a central vacuum system comprising a hose storage area and a vacuum inlet valve. The system has a manual switch which can independently activate the vacuum system to create suction in the hose storage area to retract the hose and is covered when the hose is stored. The hose comprises a first end with a hose cuff for connection to the vacuum connection opening of the inlet valve, and, a second end with a wand connection for connection to a wand or other electric device. During storage, the switch is operated to activate the vacuum system generating a vacuum in the storage area and retracting the second end of the hose into the hose storage area while the hose cuff is connected to the vacuum inlet opening. Once fully retracted, except for the hose cuff, the hose cuff is removed from the vacuum inlet connection opening and the vacuum system is again manually activated by the switch to retract the remainder of hose until the hose cuff abuts a hose storage abutment surface. The inlet valve has a hose access door with a seal providing access to the hose storage area which may be separate from a waste conveying portion to provide more hygienic storage of the hose.

17 Claims, 24 Drawing Sheets

2 pipes completely separated on inlet valve side
Hose access door/chamber only connect to hose storage pipe;
Stand dual-volt inlet valve connect to waste conveying pipe.

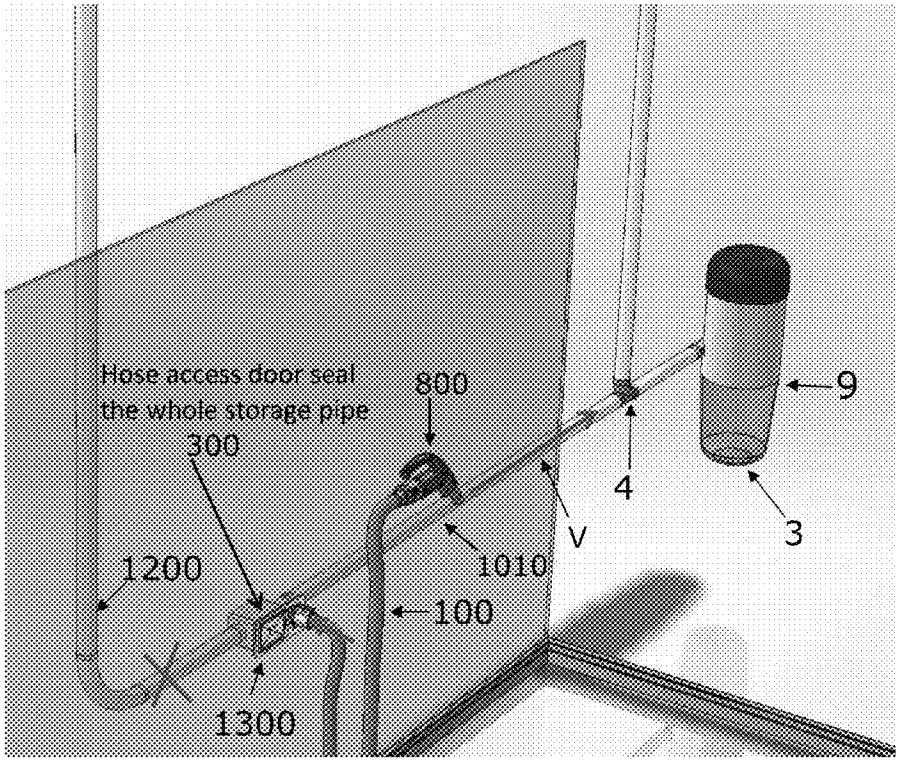

Pulling the hose out of the storage pipe and connect to the Dual-volt inlet valve.
Close the hose access door then operate the system same as aforementioned.
Because of the seal on hose access door, there is no air flow in the hose storage pipe. All dirt and dust will be sucked through the hose, inlet valve and waste conveying pipe then collected in the vacuum unit.
No dust go through the hose storage pipe.

FIG. 18

Similar inlet valve box but the hose stored to another side

The individual hose access box

Same function as the inlet valve box but without the inlet valve part.

**

*Model 1: hose access door/chamber and inlet valve are built on one body, but their air way is separated.*

*Model 2: Physically separate the hose access chamber and inlet valve, give more flexibility for retrofitting.*

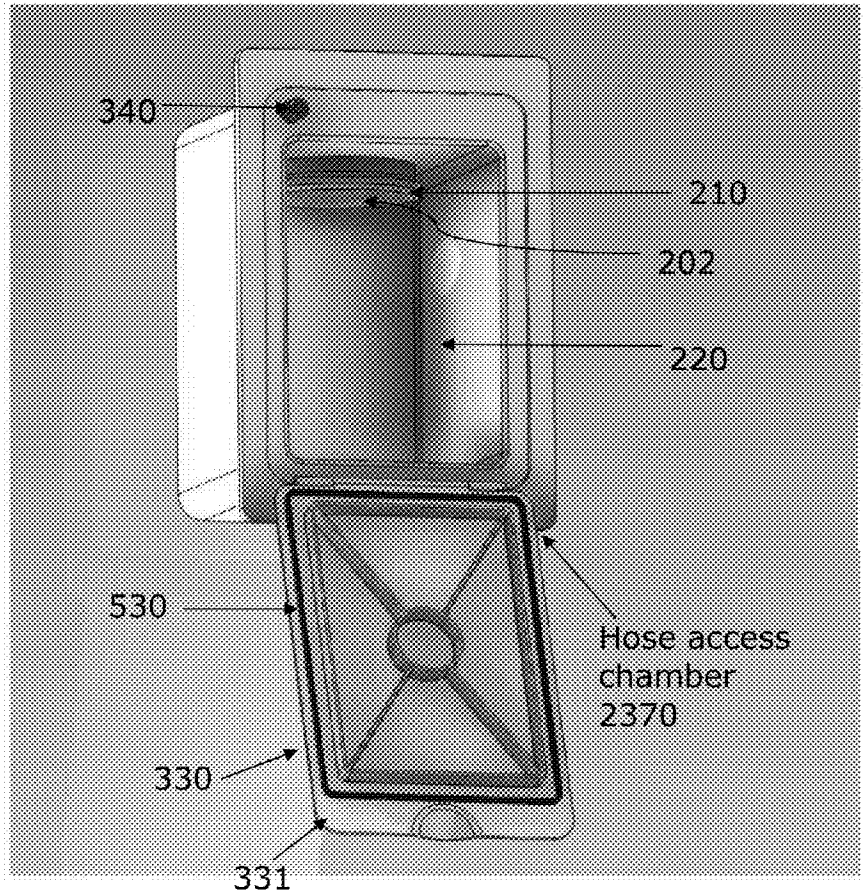

FIG. 23

SYSTEM AND METHOD TO STORE AN ELECTRIC HOSE IN A CENTRAL VACUUM SYSTEM

CROSS-REFERENCE TO RELATED APPLICATION

This patent application claims the benefit of and priority to U.S. Provisional Patent Application No. 61/954,526, filed on Mar. 17, 2014, entitled SYSTEM AND METHOD TO STORE AN ELECTRIC HOSE IN A CENTRAL VACUUM SYSTEM, which is hereby incorporated by reference.

FIELD OF THE INVENTION

This invention relates generally to central vacuum systems. In particular, the present invention relates to a system for storing a hose and a method of doing same.

BACKGROUND OF THE INVENTION

Central vacuum systems have been known for a number of years. In general, central vacuum systems have a central vacuum source which is connected through a piping system to inlets. Each of the inlets can then be connected to an accessory in general, such as a hose. The inlets generally have a sealing means for sealing the inlet when another inlet connected to the system is in use. In this way, the vacuum will not be overly degraded at the inlet that is being used.

The central vacuum system can be activated to generate a vacuum in a number of ways. For instance, the central vacuum system can be activated automatically when an accessory is connected to an inlet. The central vacuum system can also be activated, for instance, by a low voltage switch.

One of the disadvantages of prior central vacuum systems has been that generally a hose must be carried to a particular inlet that is to be used. The hose can then be used to vacuum an area associated with the inlet. Generally, this area can be large in order to decrease the number of inlets required thereby decreasing the cost of installing the central vacuum system.

However, as the area associated with an inlet increases the hose used to vacuum the area associated with the inlet must also increase. Having larger hoses to connect to the inlet decreases the convenience of using the central vacuum system. While there is some advantage to using a larger hose to clean a large area around an inlet, there is some inconvenience in storing and moving the hose from one inlet associated with an area to another inlet associated with another area.

Furthermore, several rooms or areas associated with a particular inlet may, by their geography, be small. Nevertheless, rather than having hoses of different lengths, the user may need to use a larger hose simply because that is the only type of hose the user may have for the entire central vacuum system.

Several systems have been proposed in the past whereby hoses can be permanently stored in the wall so as to be easily accessible. The disadvantage of at least some of these systems is that the hose, because of its length, is difficult to store and recover, involving complicated and expensive installation processes and mechanisms for extracting and retracting the hose from the storage space. Sometimes the hose is also retracted too far into the wall and is difficult to remove.

Moreover, the cost of maintaining these systems is high because it is difficult to access the hose, for use in cleaning, or, to replace the hose if it becomes damaged. Also, hoses may become dirty by their use and may occasionally need to be cleaned which can be difficult if permanently stored in the wall. More frequently, hoses, over time, will degrade and will require replacement. Furthermore, it is not uncommon for hoses to be stepped on or otherwise damaged during use which can create ruptures decreasing the vacuum through the hose thereby decreasing the efficiency of the vacuuming system.

Also, existing hoses that are stored in the wall generally do not have a high voltage [such as 110V or 220V] connection. As such they cannot be used to power electric cleaning heads. This limits the effectiveness and versatility of many hoses that are currently stored in the wall.

Accordingly, while the prior art has proposed certain solutions to the central vacuum systems, the prior art devices continue to suffer from several disadvantages. These disadvantages include the high maintenance involved in replacing hoses in such systems, the difficulty with storing larger hoses to clean large areas, and the fact that they cannot be used with electric cleaning heads because they do not provide a high current electrical connection.

SUMMARY OF THE INVENTION

Accordingly, it is an object of the invention to at least partially overcome some of the disadvantages of the prior art. Also, it is an object of the invention to provide an improved type of central vacuum system inlet which is less complicated to install, use or maintain than the prior art systems, and may provide for high voltage or current carrying hoses to power an electric attachment, such as an electric cleaning head.

Accordingly, in one of its aspects, this invention provides a vacuum inlet valve for a central vacuum cleaning system comprising: a vacuum inlet connection opening in vacuum communication with a hose storage area, and, associated with a high voltage connection; a hose access opening providing access to the hose storage area; a hose access door having a seal to substantially provide a vacuum seal around the hose access opening when closed; and a manually operated switch to activate the central vacuum cleaning system; wherein a current carrying vacuum hose having a hose cuff for connection to the vacuum inlet connection opening and high voltage connection at a first end and a wand connection at the second end may be stored in the hose storage area and completely removed therefrom through the hose access opening when the hose access door is open, and, the hose access opening is vacuum sealed when the hose access door is closed to decrease vacuum degradation in the central vacuum cleaning system.

In a further aspect, the present invention provides a system for storing a hose of a central vacuum cleaning system, said system comprising: a hose storage area; a vacuum inlet valve having a vacuum inlet connection opening and an associated inlet high voltage connection, and, a hose access door having a seal and providing access to the hose storage area, and a manually operated switch to activate the central vacuum cleaning system and generate a vacuum in the hose storage area and vacuum inlet connection opening; a current carrying hose having a first end with a hose cuff for connection to the vacuum inlet connection opening, and, a second end with a wand connection; and wherein, when the hose access door is open, the hose may be stored in the hose storage area by manually operating the switch to activate the central vacuum system and generate a vacuum in the hose storage area to retract the hose, and, when the hose access door is closed, the seal substantially provides a vacuum seal decreasing vacuum degradation.

In a still further aspect, the present invention provides a method for storing a hose in a hose storage area, said hose having a first end with a hose cuff for connection to a vacuum inlet valve and a second end for connection to a wand, said method comprising: (a) placing the second end of the hose near or in the hose storage area; (b) manually activating the central vacuum system to create a vacuum in the hose storage area to retract the second end of the hose into the hose storage area; and (c) once fully retracted, including the hose cuff, closing a hose access door to create a vacuum seal in the hose storage area.

Further aspects of the invention will become apparent upon reading the following detailed description and drawings, which illustrate the invention and preferred embodiments of the invention.

BRIEF DESCRIPTION OF THE DRAWINGS

In the drawings, which illustrate embodiments of the invention:

FIG. 18 illustrates a partial view of the central vacuum system shown in FIG. 17 with the hose removed from the hose storage area according to one embodiment of the invention;

FIG. 23 illustrates the hose access chamber shown in FIGS. 21 and 22*a* and 22*b* with the hose access door opened and separated from the standard dual volt inlet valve according to a further embodiment of the invention;

DETAILED DESCRIPTION OF THE PREFERRED EMBODIMENTS

Preferred embodiments of the invention and its advantages can be understood by referring to the present drawings. In the present drawings, like numerals are used for like and corresponding parts of the accompanying drawings and common elements between embodiments.

Figure 1:
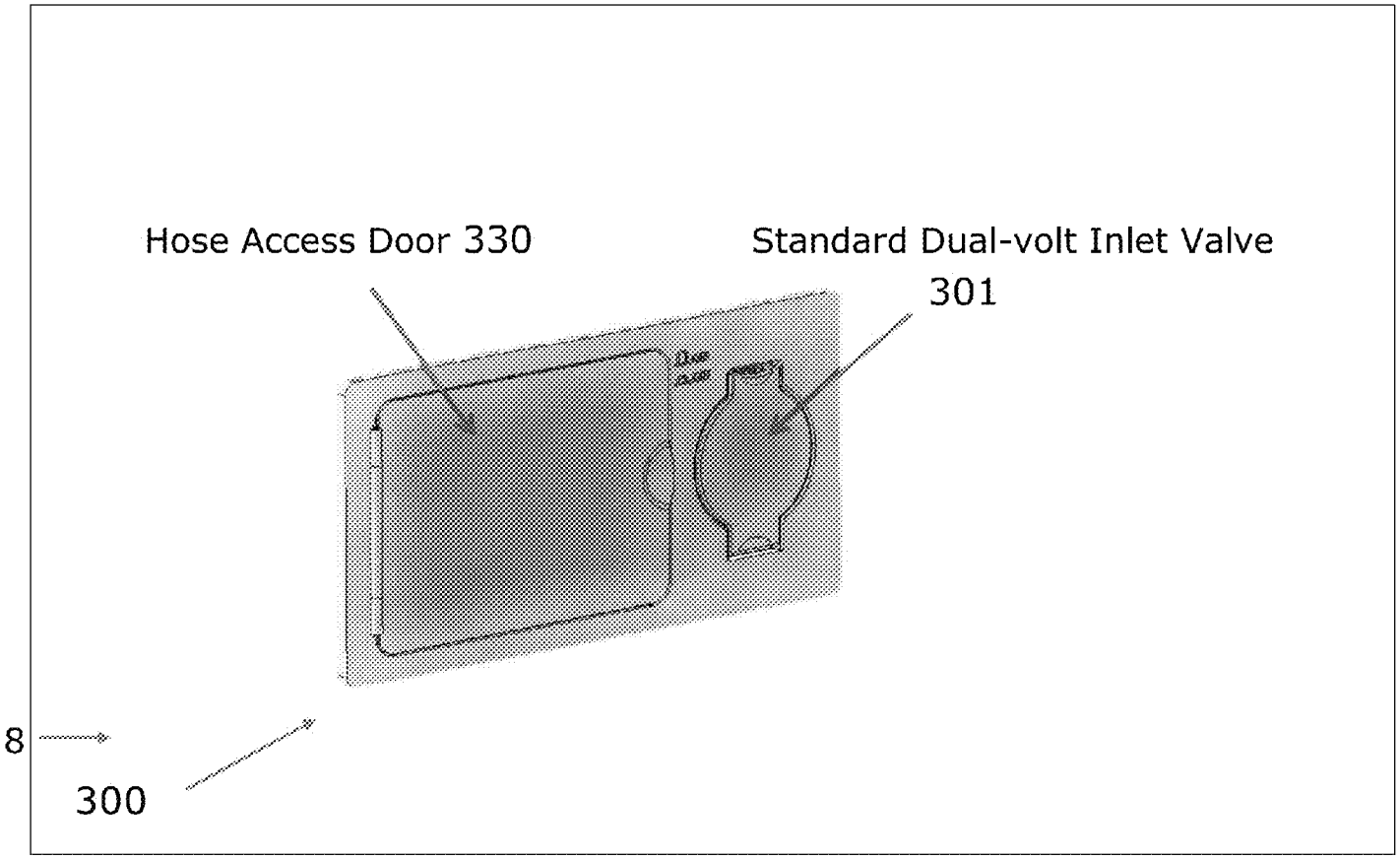
FIG. 1 illustrates a front elevation view of a vacuum inlet valve, according to one embodiment of the present invention, installed in a wall.

As shown in FIG. 1, one embodiment of the present invention relates to a vacuum inlet valve as shown generally by reference numeral 300. The vacuum inlet valve 300 has a standard dual-volt inlet valve 301 and a hose access door 330.

Figure 2A:
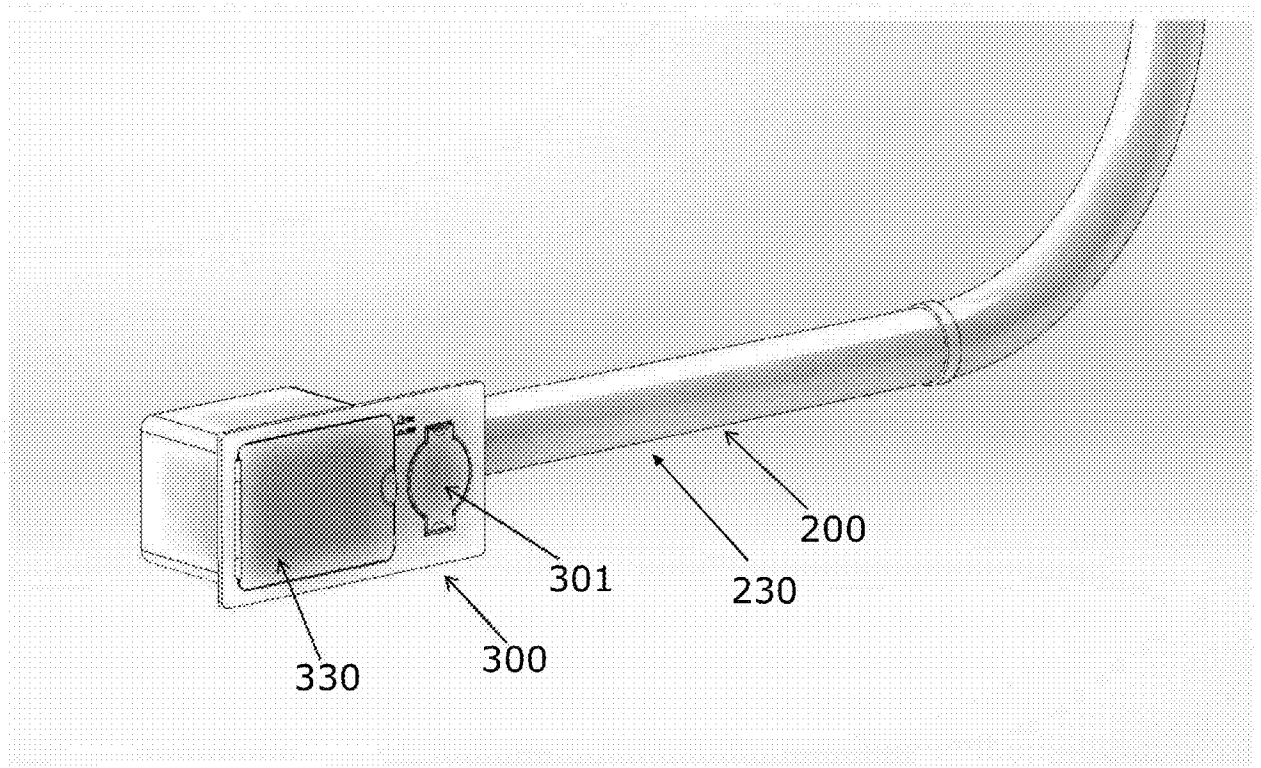
FIGS. 2*a* and 2*b* illustrate the front elevational view and top perspective view of the embodiment of the vacuum inlet valve shown in FIG. 1 with the wall removed.
Figure 2B:
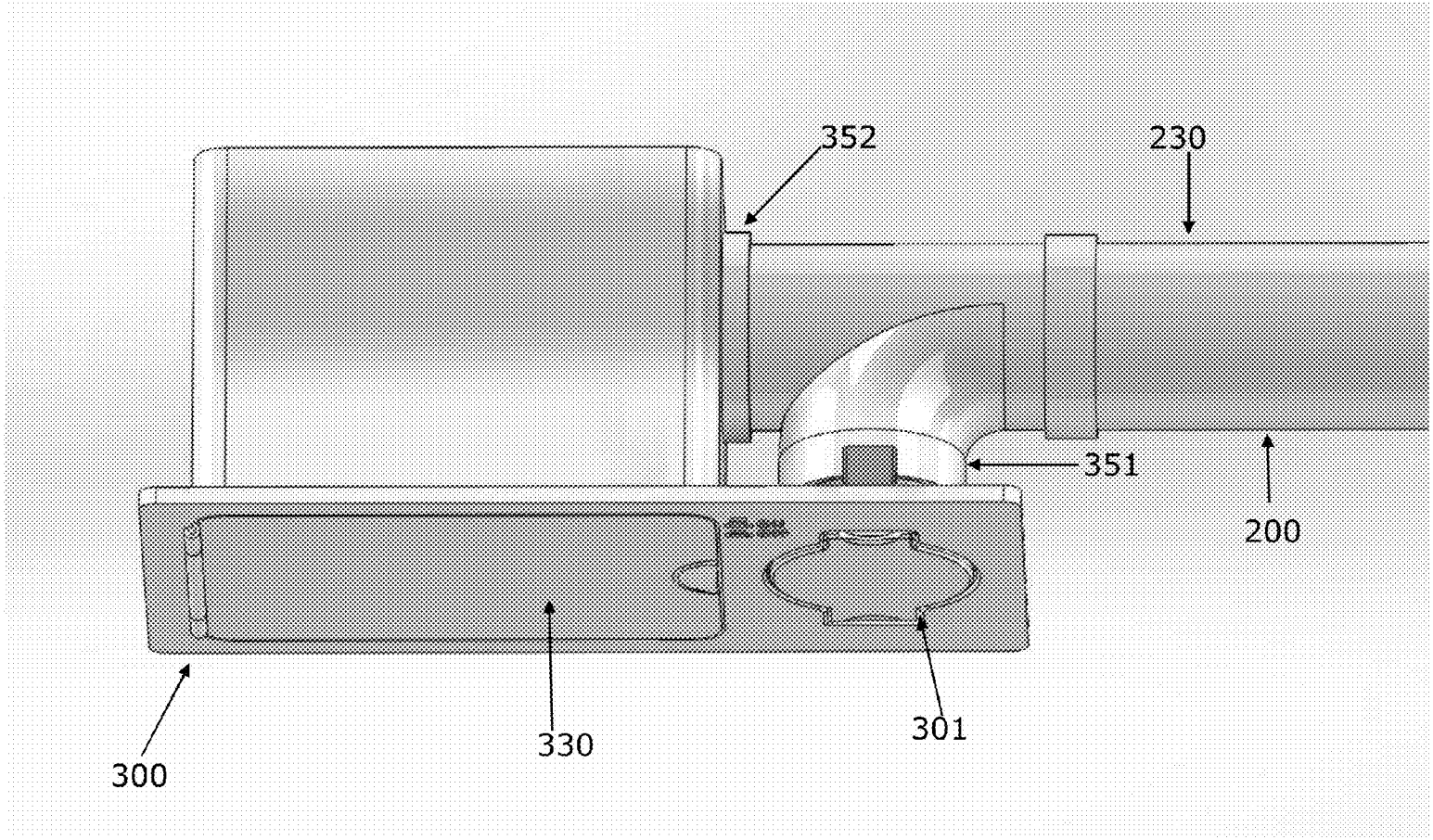
Figure 5:
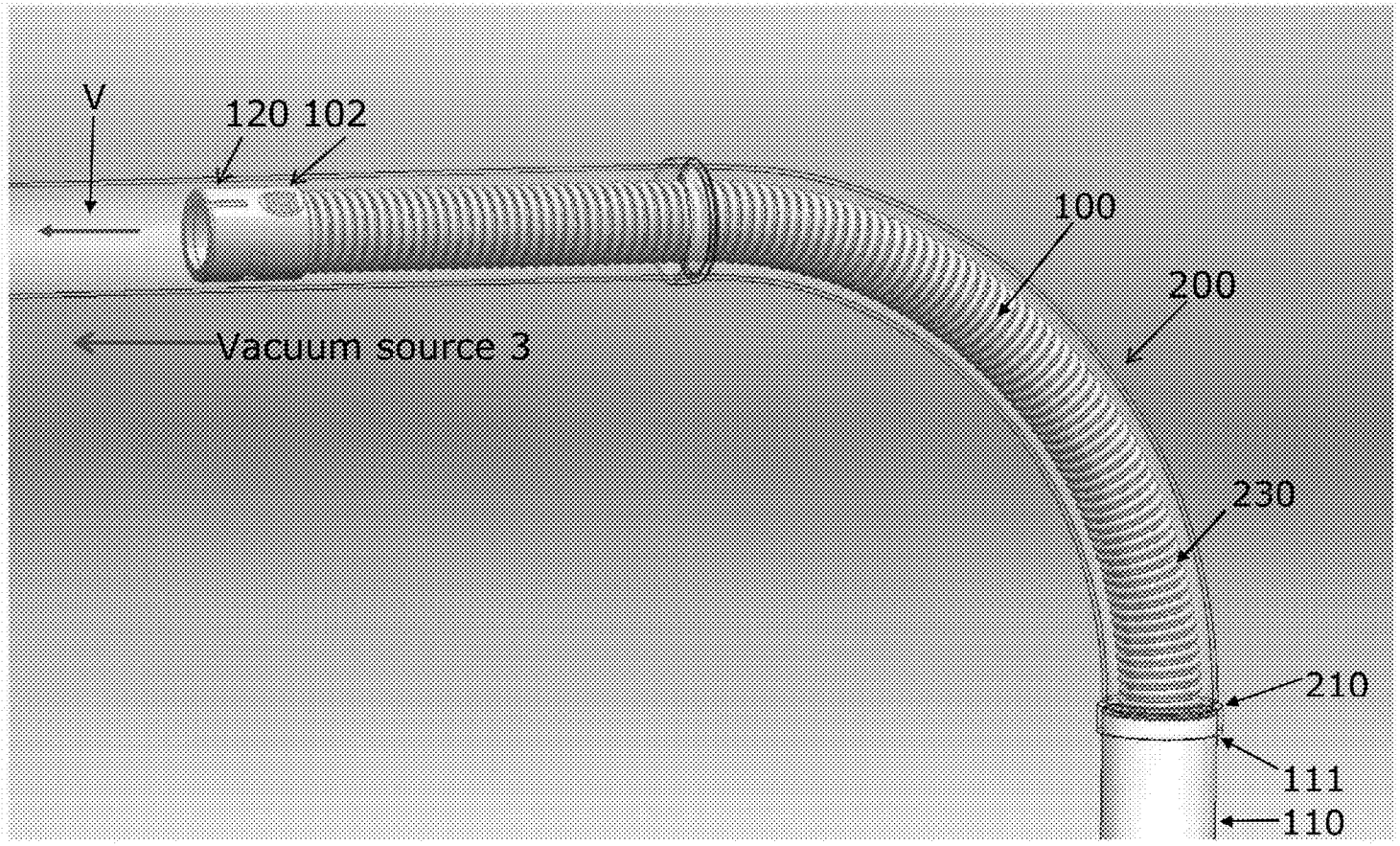
FIG. 5 illustrates the hose in the stored position according to one embodiment of the invention with the hose storage area shown as transparent for ease of illustration.
Figure 6:
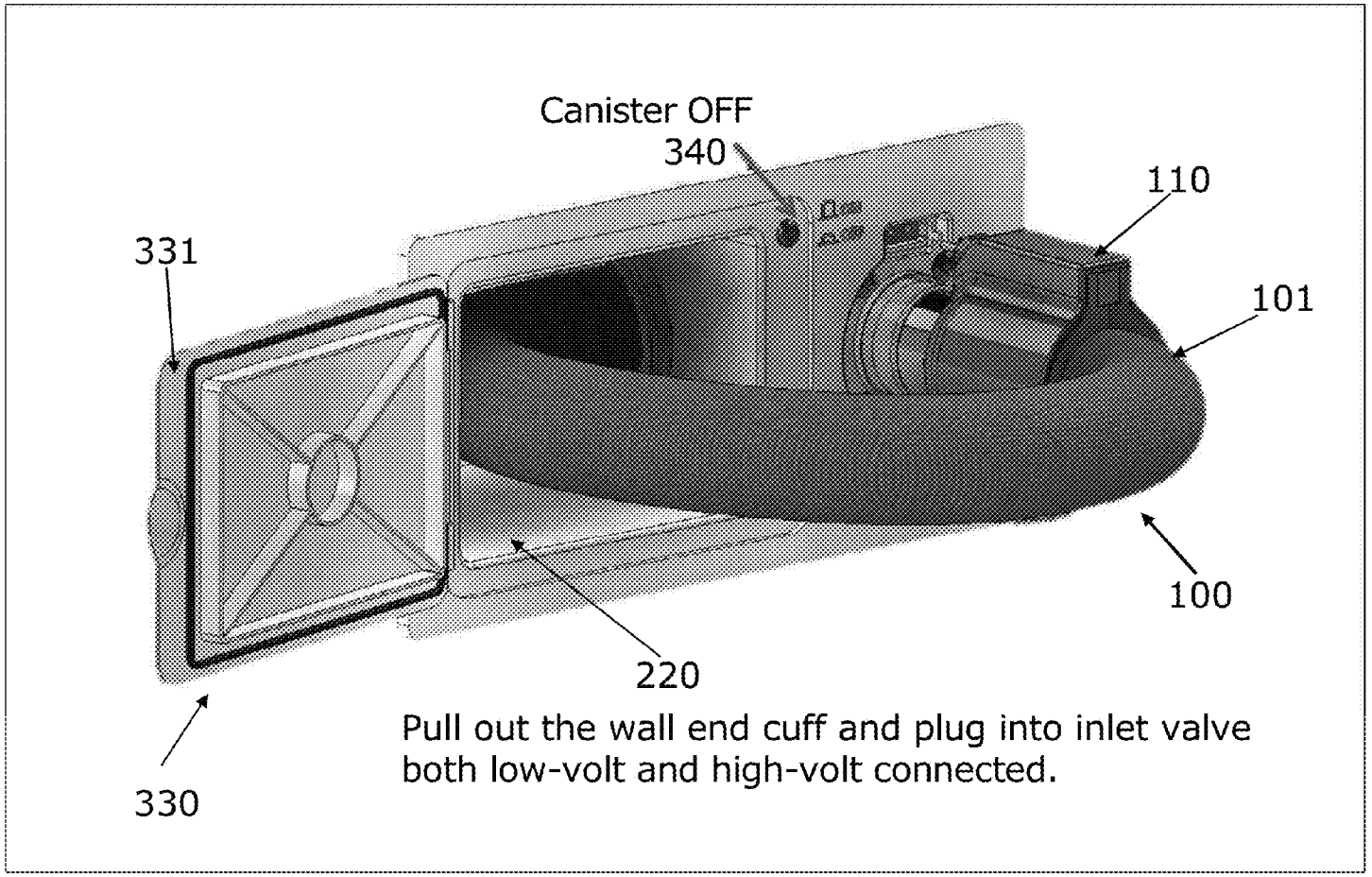
FIG. 6 illustrates the initial removal step of the hose from the hose storage area and connection of the hose cuff to the standard dual volt inlet valve, according to one embodiment of the invention.
Figure 7:
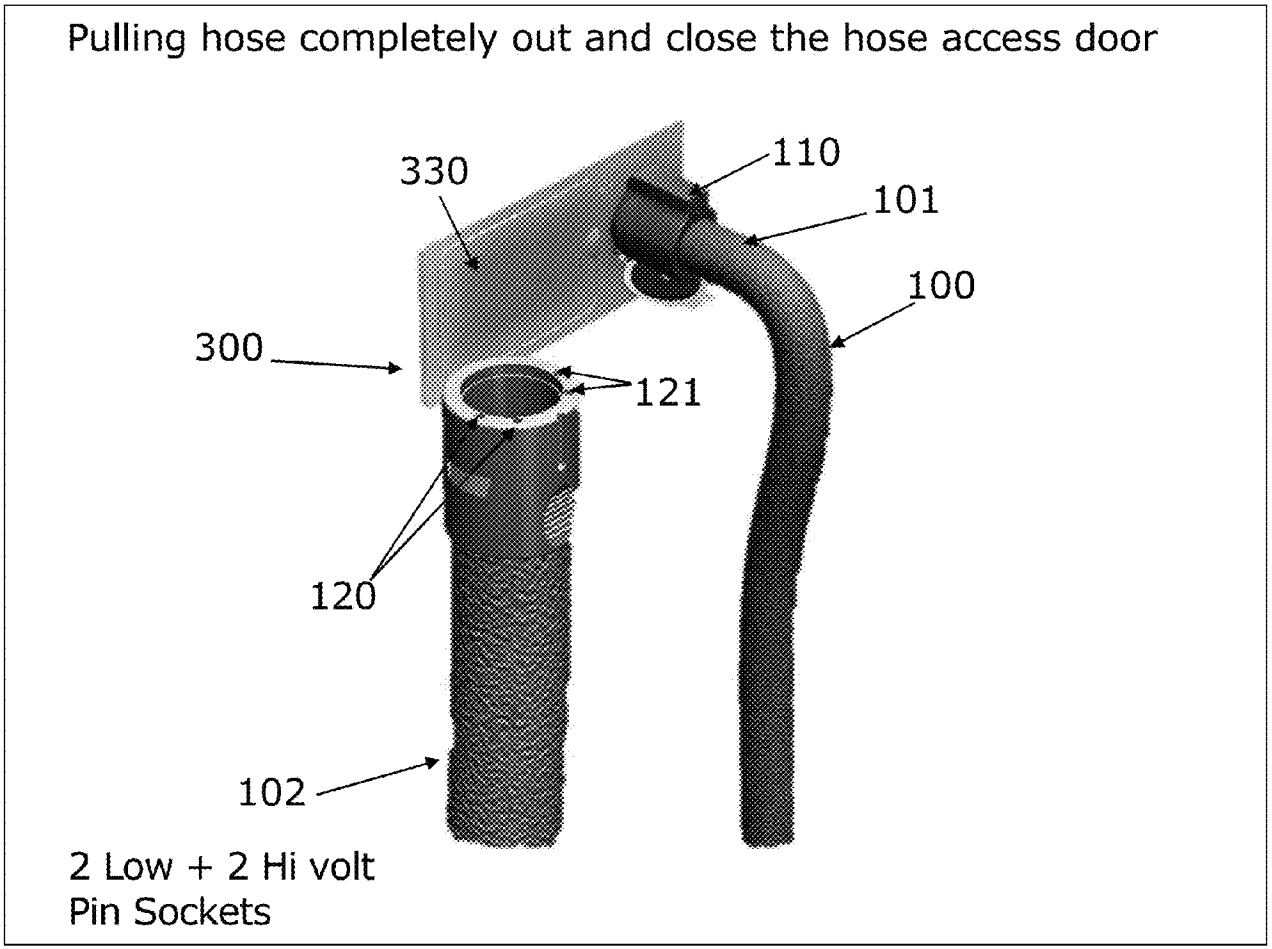
FIG. 7 illustrates the hose removed from the hose storage area, the hose access door closed and the hose cuff connected to the standard dual volt inlet valve according to one embodiment of the invention.

In FIGS. 2*a* and 2*b*, which show the vacuum inlet valve 300 behind the wall 8 of FIG. 1, a hose storage area 200 is shown in vacuum communication with the hose access door 330. The hose storage area 200 has a diameter sufficient to contain a current carrying vacuum hose shown generally by reference numeral 100, in FIG. 5. In one preferred embodiment, as seen in FIG. 5, the hose storage area 200 comprises a hose storage pipe 230 which can also be used to communicate waste to the vacuum system canister 9.

Figure 3:
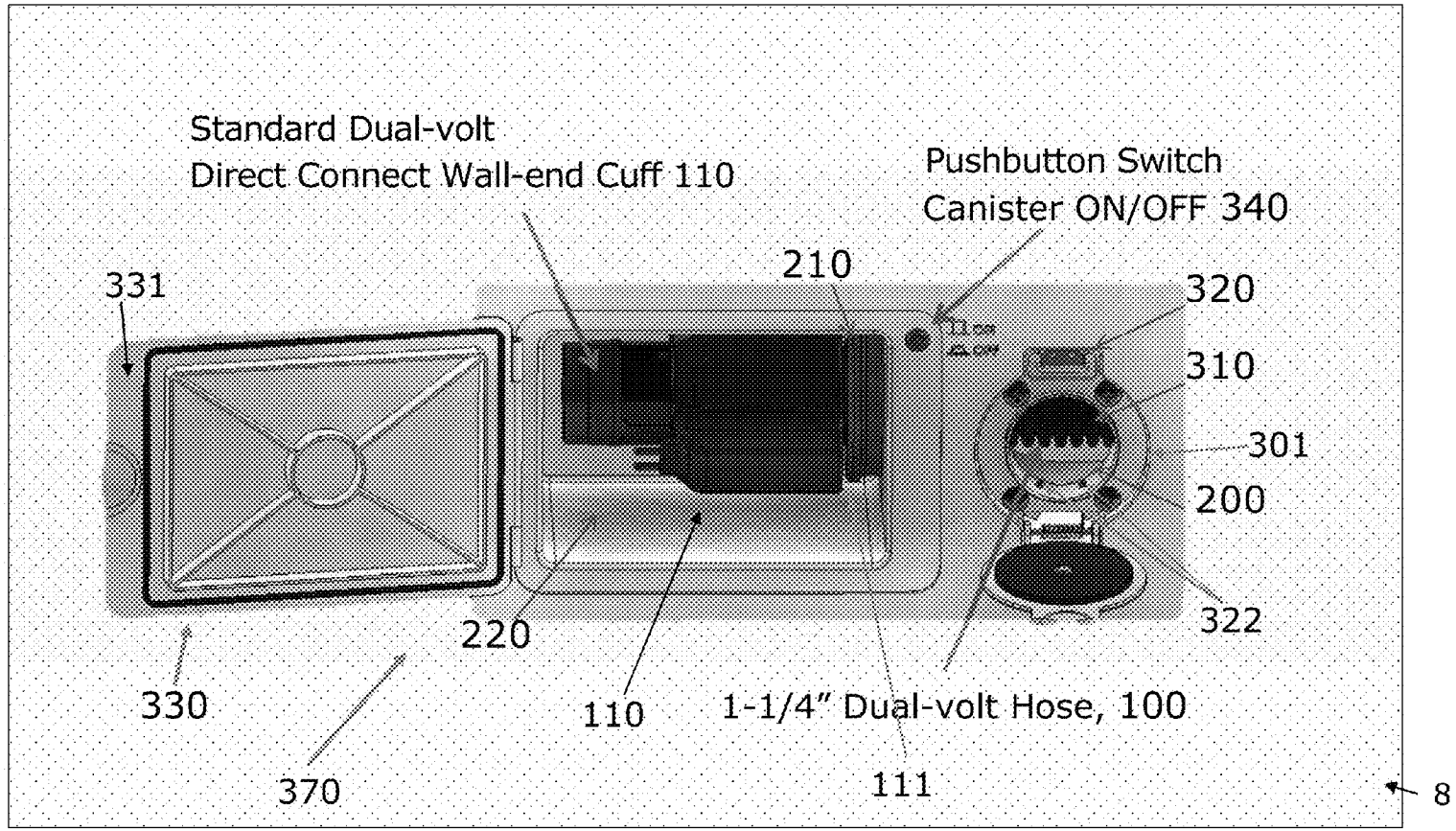
FIG. 3 illustrates the embodiment of the invention shown in FIGS. 1 and 2 with the vacuum inlet door and hose access door opened to reveal the hose cuff and hose in the stored position according to one embodiment of the invention.

FIG. 3 shows the first end 101 of the hose 100 having a hose cuff 110. The hose cuff 110 may be a standard dual-volt direct connect wall-end hose cuff 110 as is known in the art, or other types of hose cuffs 110 for connecting the hose 100 to the standard dual-volt inlet valve 301 of the vacuum inlet valve 300.

In FIG. 3, the hose 100 is shown in the stored position with all of the hose 100 stored in the hose storage area 200 and only the hose cuff 110 visible when the access door 330 is open. The hose storage area 200 comprises an abutment surface 210 at an opening 202 (shown in FIG. 11) to the hose storage area 200 which abuts against a rear surface 111 of the hose cuff 110 when the hose 100 is completely stored in the hose storage area 200. Behind the hose access door 330 is preferably a hose cuff compartment 220 for storing the hose cuff 110 when the hose 100 is in the retracted or stored position. The hose access door 330 provides access to the hose cuff 110 in the hose cuff compartment 220 through a hose access opening 332. The combination of the hose access opening 332, the hose access door 330 and the hose cuff compartment 220 may be referred to as the hose access chamber 370 through which the hose 100 is stored to, and accessed from, the hose storage area 200.

As also shown in FIG. 3, the standard dual-volt inlet valve 301 has a vacuum inlet connection opening 310 and a high voltage connection 320 which connect to the hose cuff 110 and provides power, if required, to an attachment (not shown) as well as communicating suction or vacuum from the vacuum source 3. The standard dual volt inlet valve 301 also has a low voltage connection 322 which also connects to the hose cuff 110 and is used to operate the central vacuum system (usually on and off) from the attachment through the hose 100.

The pipe 230 may be connected to the vacuum inlet valve 300 by a T-connection or other component, as shown in FIG. 2*b*. The vacuum inlet valve 300 has a first vacuum opening 351, which is connected to the vacuum inlet connection opening 310, and a second vacuum outlet opening 352, which is connected to the hose storage area 200. As shown in FIG. 2*b*, the first and second vacuum outlet openings 351, 352 are proximate each other such that fluid flow through each would combine near the vacuum inlet valve 300. In particular, fluid flow through each of the vacuum outlet openings 351, 352 would combine within the length of the hose 100 stored in the vacuum storage area 200 such that there would be overlap between the hose storage area 200 and the portion of the pipe 230 conveying vacuum waste during use of the hose 100. In a preferred embodiment, the hose 100 is about 20 to 30 feet long, but could be about 50 feet long.

The vacuum inlet valve 300 also comprises a manually operated switch 340 which can be operated by the user to manually activate the vacuum V of the central vacuum system 10 independent of the current carrying hose 100. The switch 340 may be a push button switch, as preferably shown in FIG. 3, but any switch which can be operated by the user independent of the current carrying hose 100 may be used. Preferably, the switch 340 is associated with the hose access door 330. In particular, it is preferred if the switch 340 is located behind a portion 331 of the hose access door 330 when the hose access door 330 is in the closed portion (as shown for instance in FIG. 1 where the switch 340 is not visible behind the closed hose access door 330). In this way, the switch 340 will be protected when the hose access door 330 is in the closed position to prevent accidental activation of the vacuum source 3 of the central vacuum system 10. More preferably, the switch 340 is a push-button switch with "OFF" or "non-active" corresponding to the "pushed-in" position and "ON" or "active" corresponding to the "pushed-out" position. In this way, the switch 340 is automatically pushed to the "OFF" or "non-active" setting when the hose access door 330 is closed to de-activate the vacuum source 3.

Figure 4:
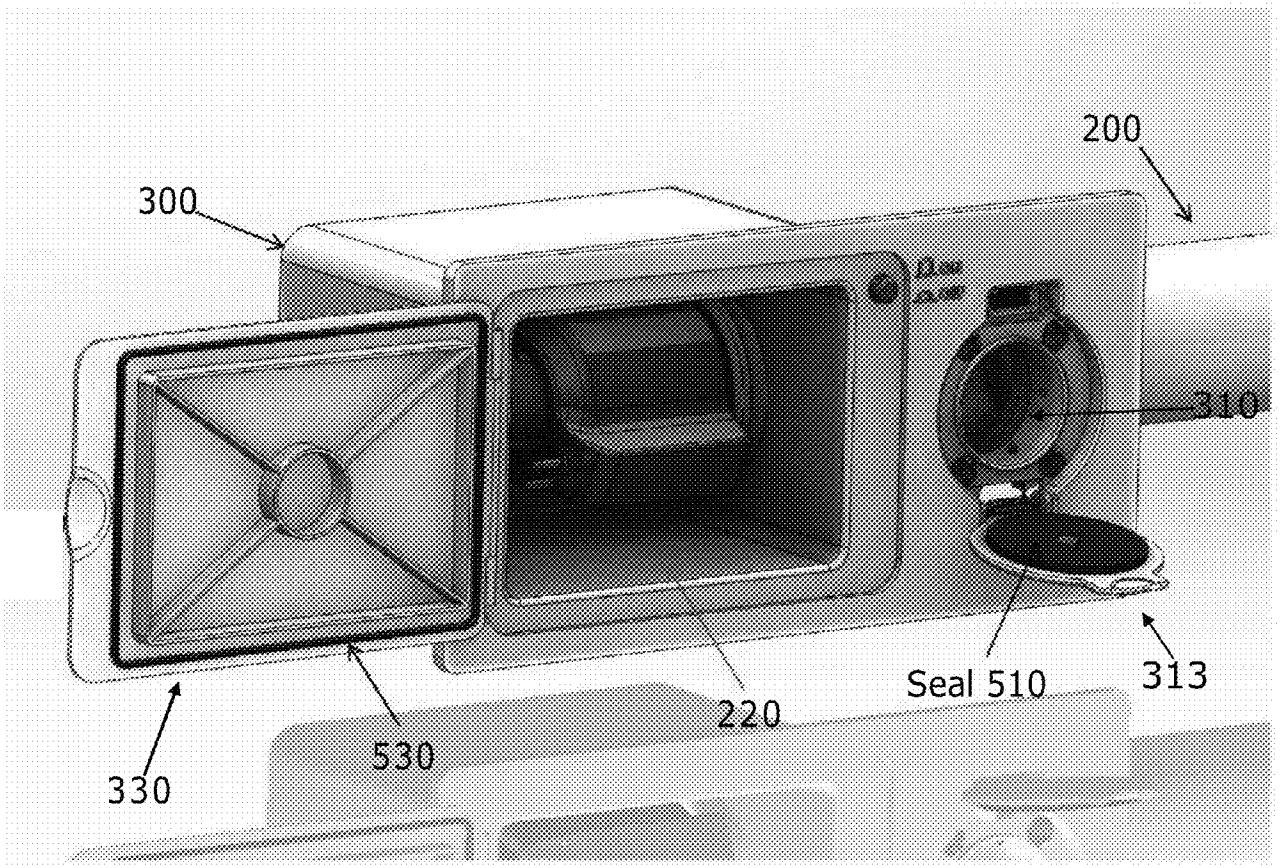
FIG. 4 illustrates the central portion of the vacuum inlet valve illustrated in FIG. 3 with the wall removed according to one embodiment of the invention.

FIG. 4 shows a further embodiment of the vacuum inlet valve 300 with the wall portion 8 removed. As shown in FIG. 4, the hose 100 is stored in the hose storage area 200. As shown in FIGS. 3 and 4, in one embodiment, where the hose storage area 200 also communicates waste, such as dust and dirt, when the system 10 is in use, the vacuum inlet connection opening 310 is preferably substantially perpendicular to the hose storage area 200. In this way, in a preferred embodiment, the hose 100 may be seen through the vacuum inlet connection opening 310 when the vacuum inlet door 313 of the connection opening 310 is open. This can be useful to determine if the hose 100 is stored in the vacuum storage area 200 as the same hose 100 could be used, and stored, at different vacuum inlet valves 300.

As also illustrated in FIG. 4, seals 510, 530 are present at the vacuum inlet door 313 for the vacuum inlet connection opening 310 and the hose access door 330, respectively, to substantially provide a vacuum seal when the doors 313, 330 are closed. The doors 313, 330 may preferably have a spring, or other biasing means, to press or bias the seals 510, 530 against the openings 310, 332, respectively, to assist in preventing degradation of the vacuum when other inlets (not shown) are used. This also assists in preventing vacuum degradation when one of the vacuum inlet connection opening 310 or hose access door 330 are in use and the other 330, 310, is not.

When the hose 100 is to be removed from the stored position, the hose access door 330 is opened, as shown in FIG. 3, and the hose 100 is removed by hand through the hose access opening 332 off the hose access chamber 370. All the while, if desired, the user can see the hose 100 moving out of the hose storage area 200 by opening the vacuum inlet door 313 and looking through the vacuum connection opening 310.

Figure 8:
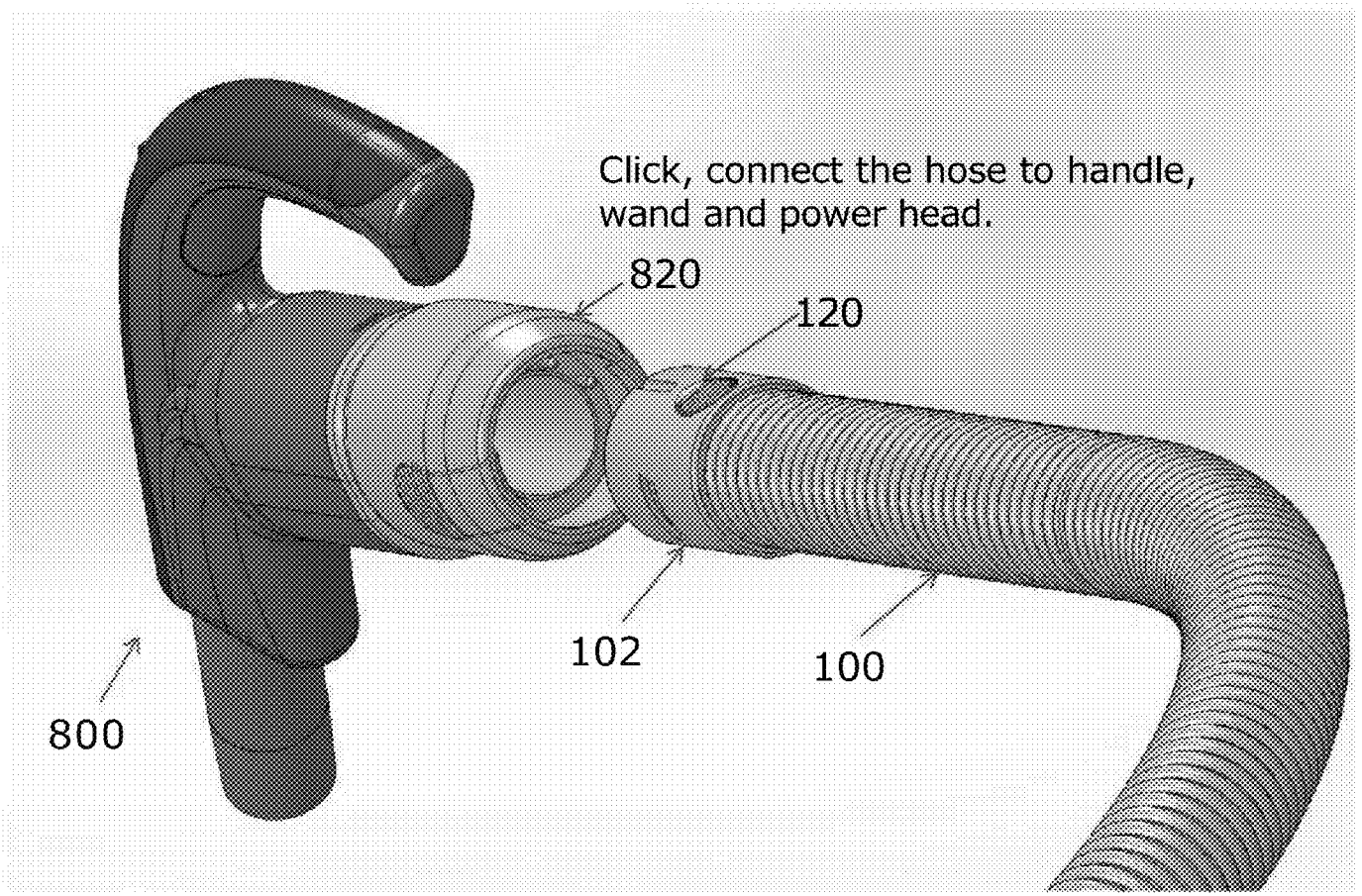
FIG. 8 illustrates the wand connection at the second end of the hose being connected to a wand according to one embodiment of the invention.
Figure 9:
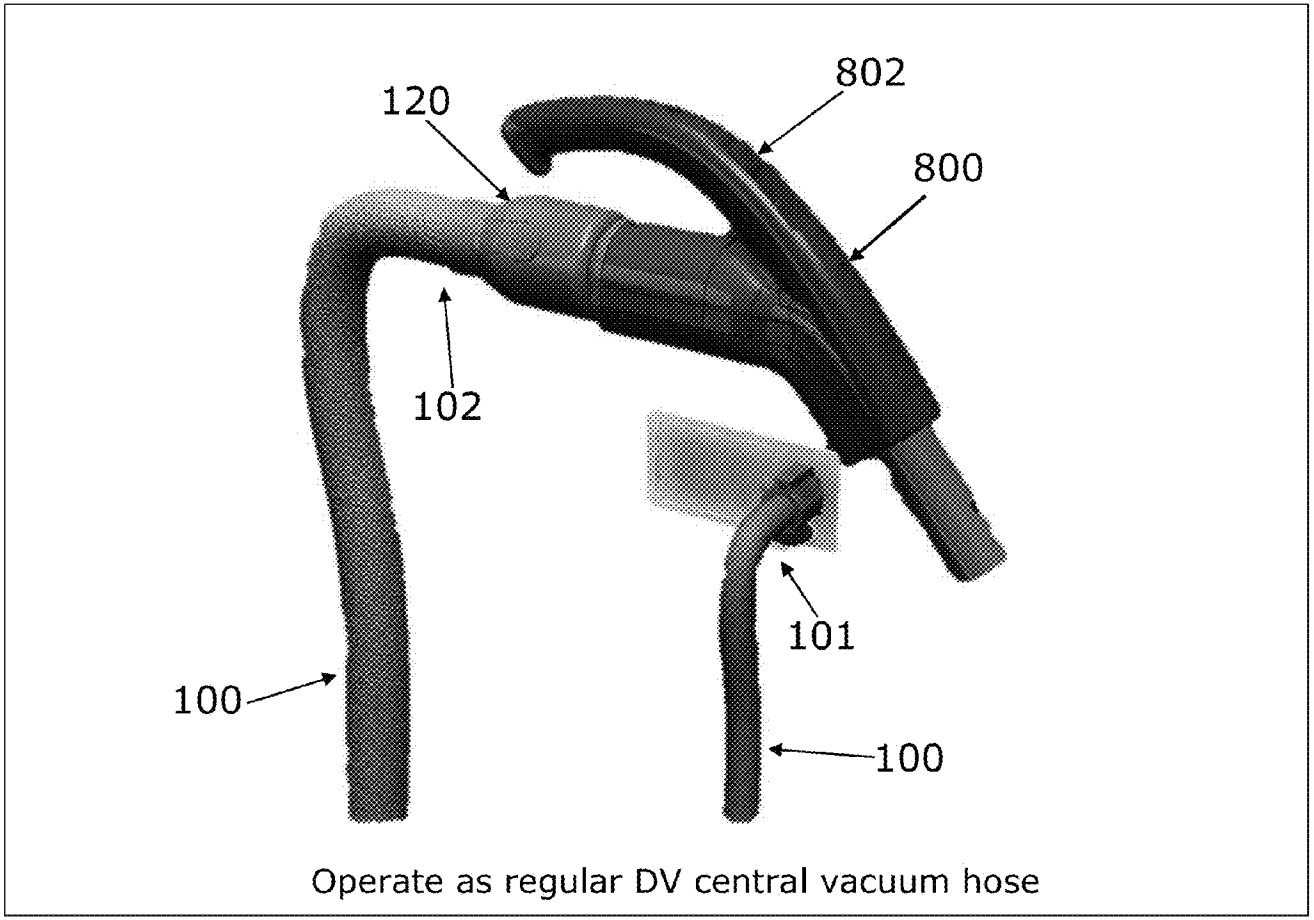
FIG. 9 illustrates the vacuum inlet valve, hose and wand assembled and ready to use for cleaning with a cleaning head or other power device (not shown) according to one embodiment of the invention.

Once the hose 100 has been removed from the hose storage area 200, the hose cuff 110 may be connected to the vacuum inlet connection opening 310 and the high voltage connection 320. The second end 102 of the hose 100 preferably has a wand connection 120 that can connect to a wand 800 as shown in FIG. 8. The wand 800 preferably has a power connection 820 to receive the wand connection 120 at the second end of the hose 100. In this way, power can be supplied from the vacuum inlet high voltage connection 320 through the current carrying hose 100 to the wand 800 and, ultimately, to an electric cleaning head or other power device (not shown) connected to the wand 800. To facilitate this, the wand connection 120 preferably has 2 high voltage pin sockets 121 to provide high voltage power to the wand 800. The wand connection 820 preferably also has 2 low voltage pin sockets 122 to facilitate turning the vacuum cleaning system on-and-off through a switch 802 on the wand 800. When the vacuum cleaning system 10 is on, a vacuum V can be supplied from the vacuum source 3 through the vacuum inlet connection opening 310, the hose 100 and the wand 800 ultimately to the cleaning head or other device (not shown) connected to the wand 800 for cleaning. When in the stored or retracted position, the wand connection 120 is stored in the storage area 200. In this way, the wand connection 820, including the high voltage pin sockets 121 and the low voltage pin sockets 122 are protected from damage. Accordingly, the hose storage area 200 should preferably have a diameter sufficient to accommodate the hose 100 and the wand connection 120, but not the hose cuff 110 which remains in the hose cuff compartment 220 when the hose 100 is in the completely stored or retracted position.

Figure 10:
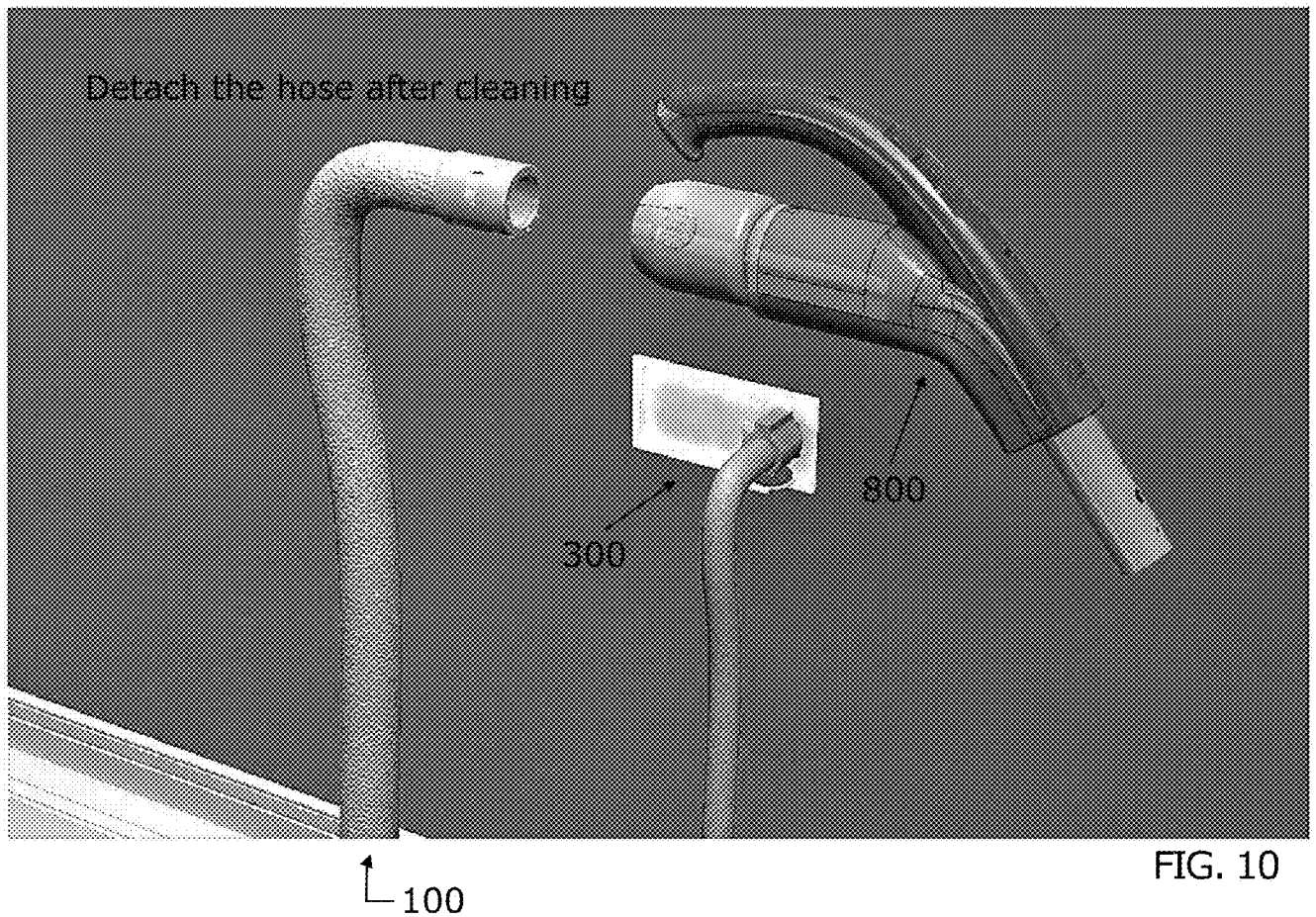
FIG. 10 illustrates the detachment of the hose from the wand after cleaning in preparation for storage of the hose in the storage area according to one embodiment of the invention.

After use, as shown in FIG. 10, the wand 800 can then be detached from the wand connection 120 at the second end 102 of the hose 100. The hose cuff 110 at the first end 101 may remain connected to the vacuum inlet connection opening 310 and high voltage connection 320 while the second end 102 is retracted into the hose storage area 200.

Figure 11:
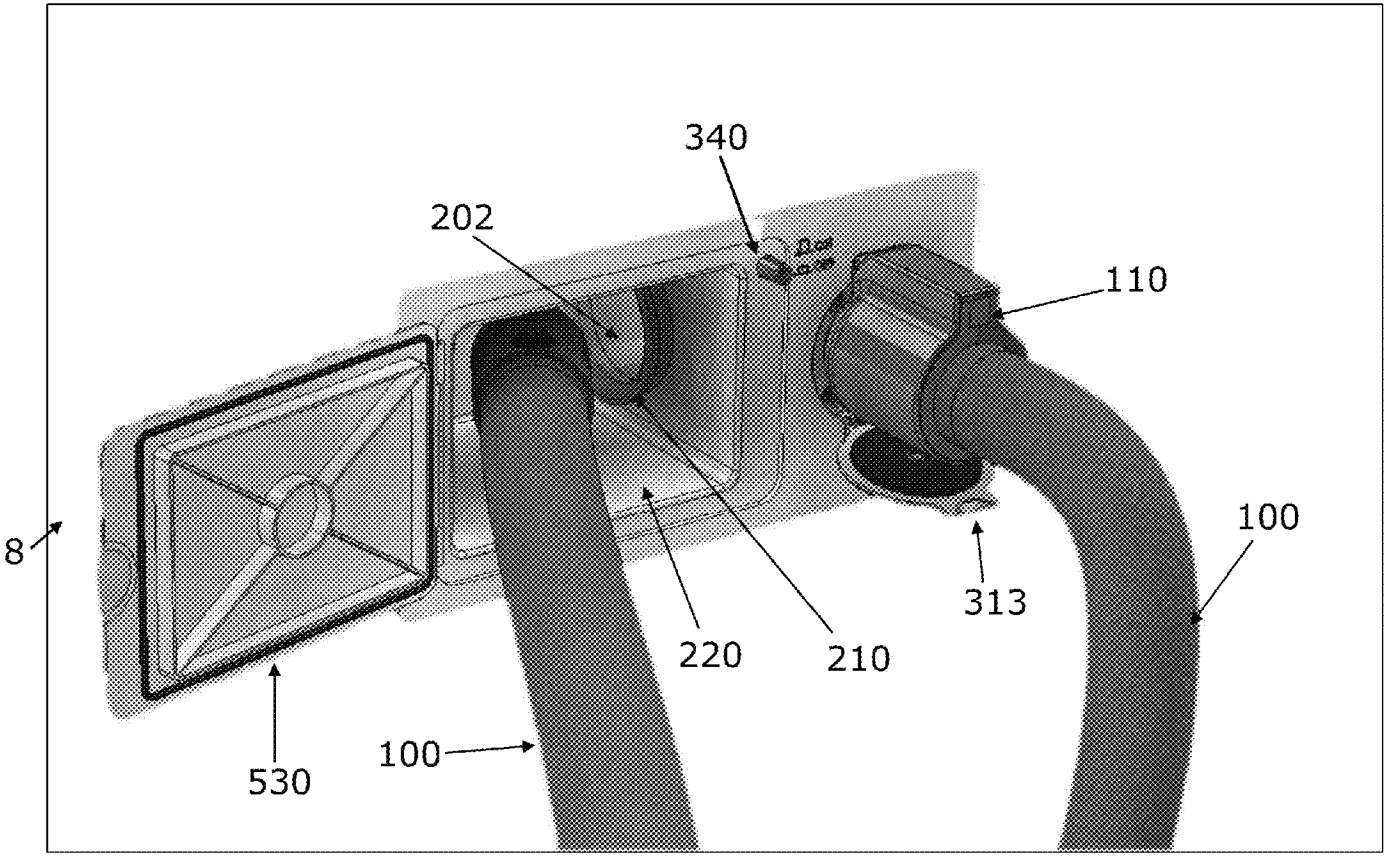
FIG. 11 illustrates the initial storage of the hose into the hose storage area with the second end in the hose access chamber and the hose cuff still connected to the standard dual volt inlet valve according to one embodiment of the invention.

As shown in FIG. 11, the second end 102 of the hose 100 having the wand connection 120 is then initially inserted into the hose cuff compartment 220 and/or inserted into or placed near the hose storage area 200 through the hose access opening 332 of the hose access chamber 370. While the second end 102 of the hose 100 is initially inserted in the opening 202 of the storage area 200, or, is at least in the proximity thereof, such as in the hose cuff compartment 220, the user manually operates the switch 340 to activate the vacuum source 3 of the central vacuum system 10 and create a vacuum V in the hose storage area 200 which retracts the second end 102 of the hose 100 into the hose storage area 200.

Figure 12:
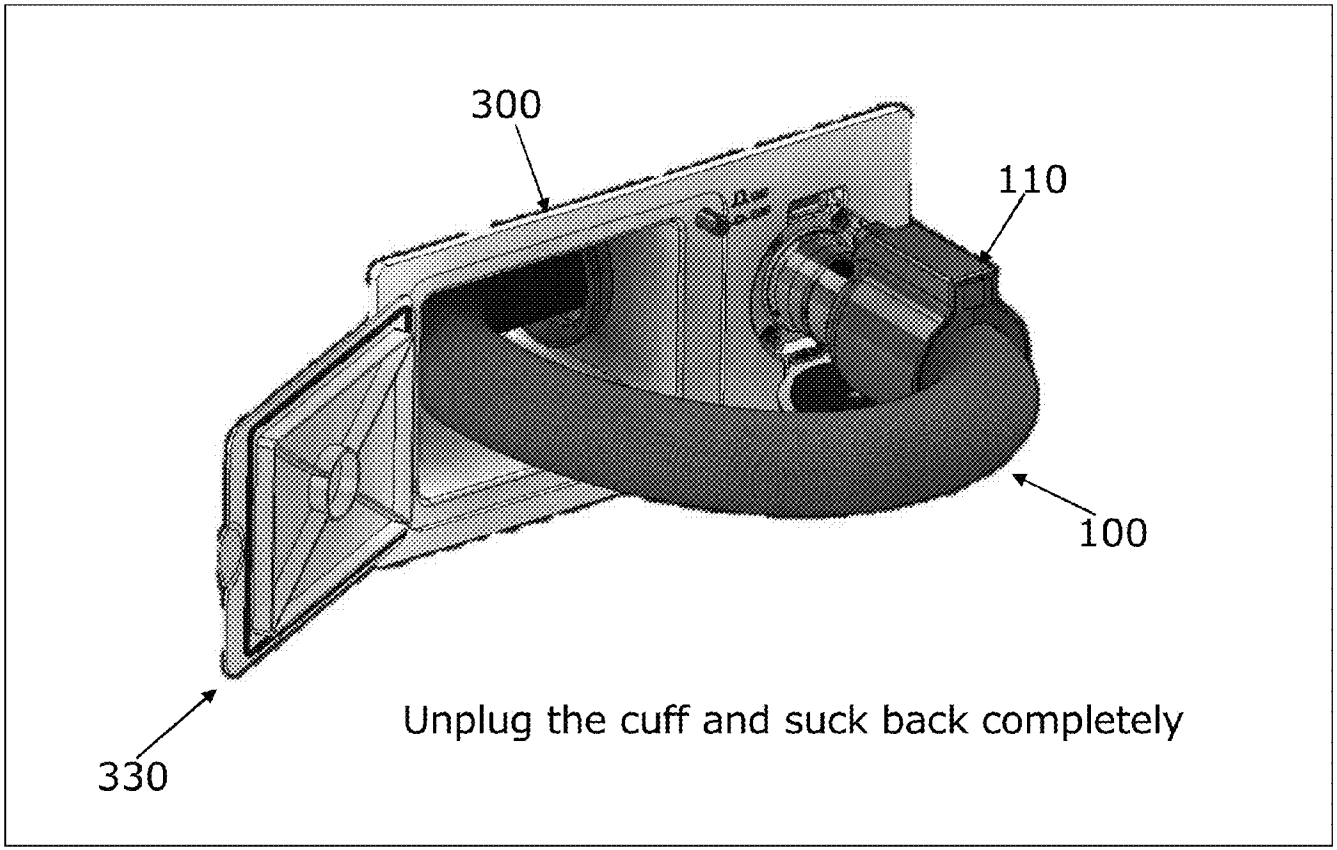
FIG. 12 illustrates the majority of the hose, except the hose cuff, retracted into the hose storage area and the hose cuff being removed from the standard dual volt inlet valve prior to completely inserting the hose cuff into the hose cuff compartment according to one embodiment of the invention.
Figure 13:
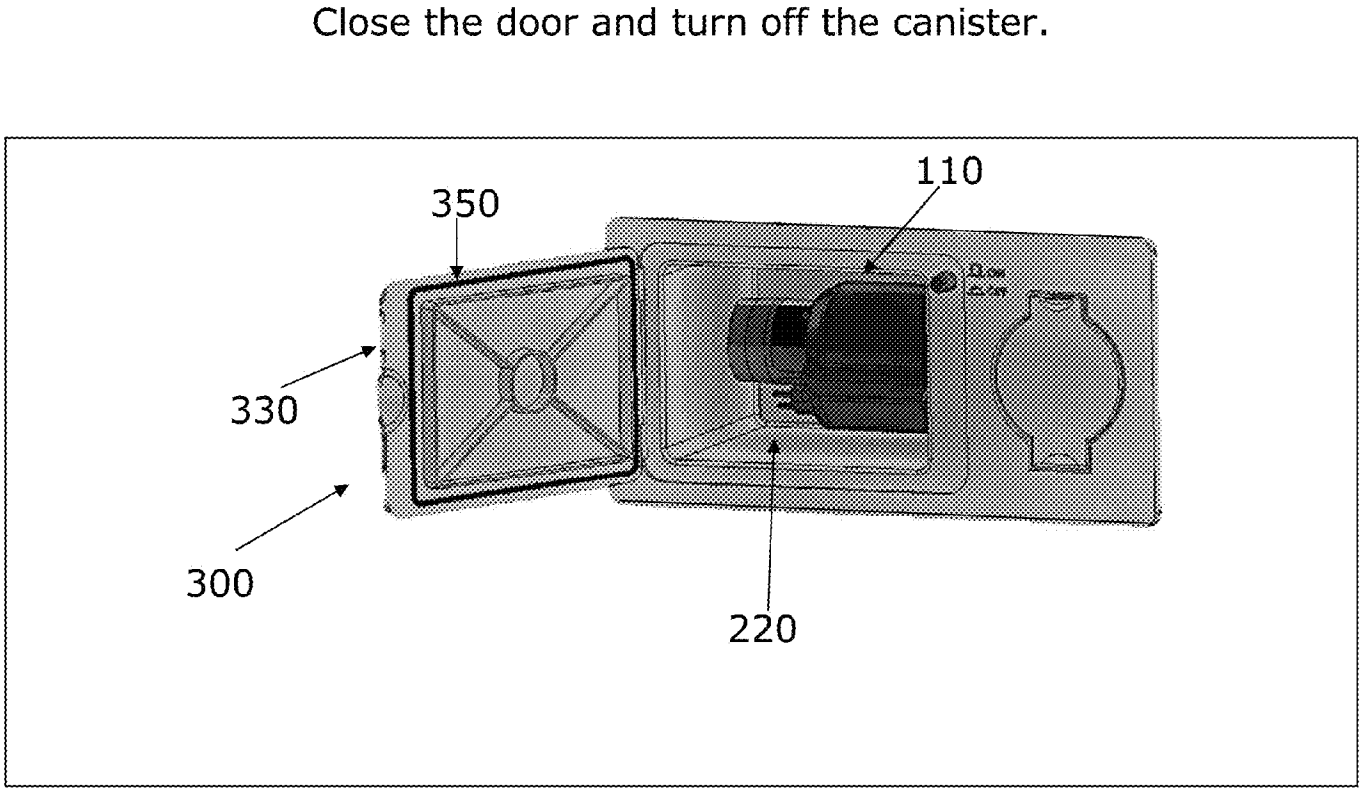
FIG. 13 illustrates the remainder of the hose having been retracted into the hose storage area, the hose cuff in the hose cuff compartment and the hose access door being closed to seal the hose access chamber and cover the manual switch according to one embodiment of the invention.

The user then continues to activate the switch 340 until the hose 100 has been completely retracted into the hose storage area 200, except for the hose cuff 110 which remains connected to the standard dual volt inlet valve 301, as shown in FIG. 12. In a preferred embodiment, the hose cuff 110 remains connected to the standard dual-volt inlet valve 301 and in particular the vacuum inlet connection opening 310 and the high voltage connection 320, while the switch 340 is activated and the second end 102 of the hose 100 is retracted into the hose storage chamber 200. One advantage of securing the hose cuff 110 to the standard dual-volt inlet valve 301 while the hose 100 is being retracted into the hose storage chamber 200 by the vacuum of the vacuum source 3 is to have the first end 101 of the hose 100 secured thereby avoiding the first end 101 and the hose cuff 110 hitting the wall 8, the user or the hose access chamber 370. This is particularly important in situations where the vacuum source 3 is particularly strong and the hose 100 may be retracted quickly into the hose storage chamber 200 which could cause a "whip lash" effect if the first end 101 and the hose cuff 110 are not secured to the dual volt inlet valve 301. Another advantage of securing the hose cuff 110 to the dual volt inlet valve 301 while the hose 100 is being retracted into the hose storage area 200, is to avoid damaging the hose cuff 110, and hose cuff compartment 220 such as by the "whip lash" effect referred to above, and also to avoid over insertion of the rear surface 111 of the hose cuff 110 beyond the abutment surface 210 which could result in the hose cuff 110 becoming stuck in the hose storage area 200 and/or damage the abutment surface 210, the hose storage area opening 202, or both.

Once the hose 100 is fully retracted into the hose storage area 200, except for the hose cuff 110, the hose cuff 110 may be removed from the standard inlet valve 301 and the hose cuff 110 and remainder of the first end 101 of the hose 100 may be retracted into the hose cuff compartment 220. This can be done manually if desired, or, by further operation of the switch 340 to activate the vacuum system thereby generating a vacuum in the hose storage area 200. It is noted that when the hose cuff 110 is removed from the vacuum inlet connection opening 310, and stored in the hose cuff compartment 220 at the opening 202 of the hose storage area 200, the vacuum inlet door 313 will be closed. Generally, a spring, or other means will bias the seal 510 on the vacuum inlet door 313 against a perimeter of the vacuum connection opening 310 thereby facilitating creation of a vacuum seal to avoid degradation of the vacuum at other vacuum inlets (not shown). The vacuum inlet door 313 also covers the high voltage connection 320 to prevent damage thereto, as well as protect users from exposed high voltage electrical connections.

Once the hose 100 is fully retracted in the hose storage area 200, the rear surface 111 of the hose cuff 110 will abut against the abutment surface 210 of the storage area 200 restricting further insertion of the hose 100 into the storage area 200. At this point, the hose cuff is completely contained within the hose cuff compartment 220 and the hose access door 330 can be closed. The seal 530 upon the hose access door 330, as well as the rear surface 111 of the hose cuff 110 resting against the abutment surface 210, will facilitate creation of a vacuum seal to prevent degradation of the vacuum at other vacuum inlets (not shown) of the vacuum system 10 during operation. In the closed position, the hose access door 330 will also cover or overlap the switch 340 to prevent accidental activation.

Figure 14:
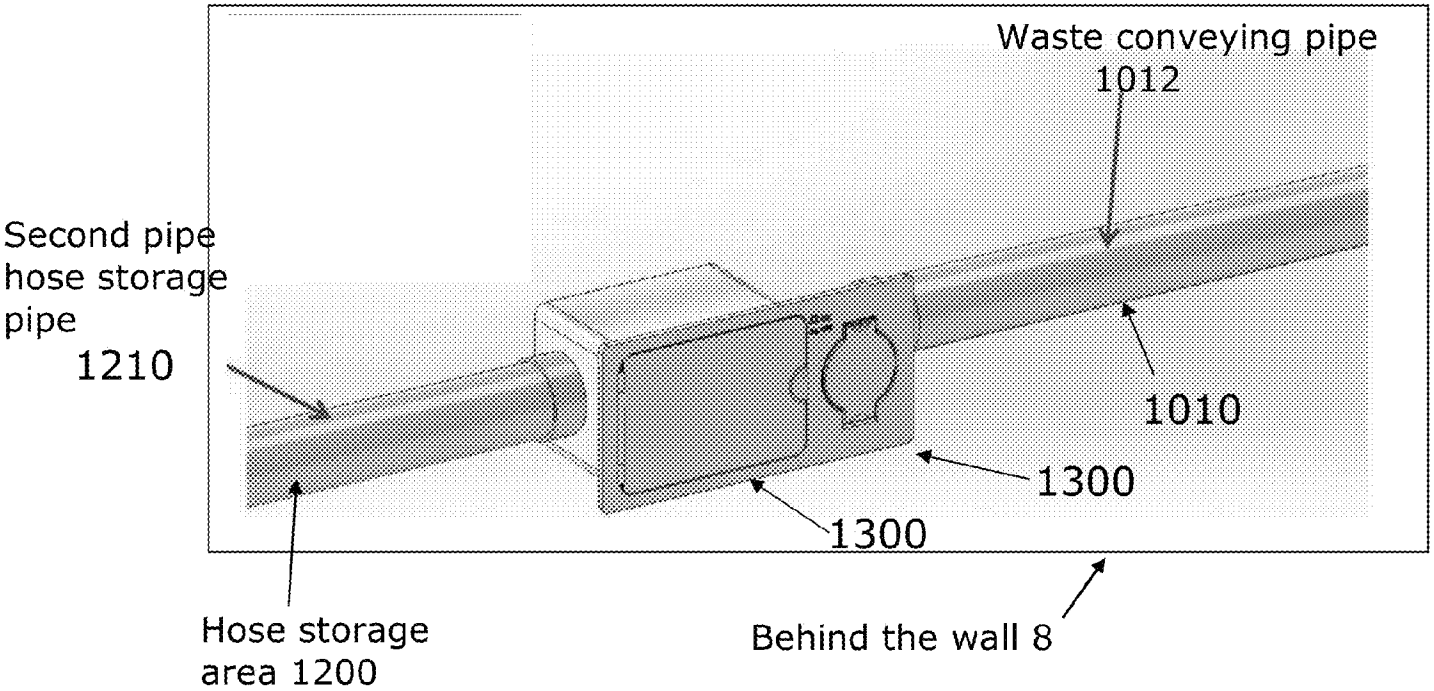
FIG. 14 illustrates a further embodiment of the present invention having a separate waste conveying pipe and hose storage area according to one embodiment of the invention.

FIGS. 14 to 20 illustrate a vacuum inlet valve, shown generally by reference numeral 1300, according to a further embodiment of the present invention. As illustrated in FIG. 14, for example, the vacuum inlet valve 1300 has two separate outlet openings 1301 and 1302. These are illustrated also in FIG. 16. The first outlet opening 1301 is connected to a waste conveying pipe, shown generally by reference 1012. The second outlet opening 1302 is connected to a hose storage area 1200. Accordingly, in this embodiment, the hose storage area 1200, represented by the hose storage pipe 1202, is separate from the waste conveying pipe 1012 connected to the first opening 1301. Similarly, the first outlet opening 1301, and the second outlet opening 1302 are not proximate, but remote to each other at least because fluid flow through each outlet openings 1301, 1302, would not combine near the vacuum inlet valve 1300, though fluid flow may combine at a location remote from the vacuum inlet valve 1300, such as near the canister 9, depending on the design of the central vacuum system 10, and in any event, may combine at a distance greater than the length of the hose 100.

Figure 15:
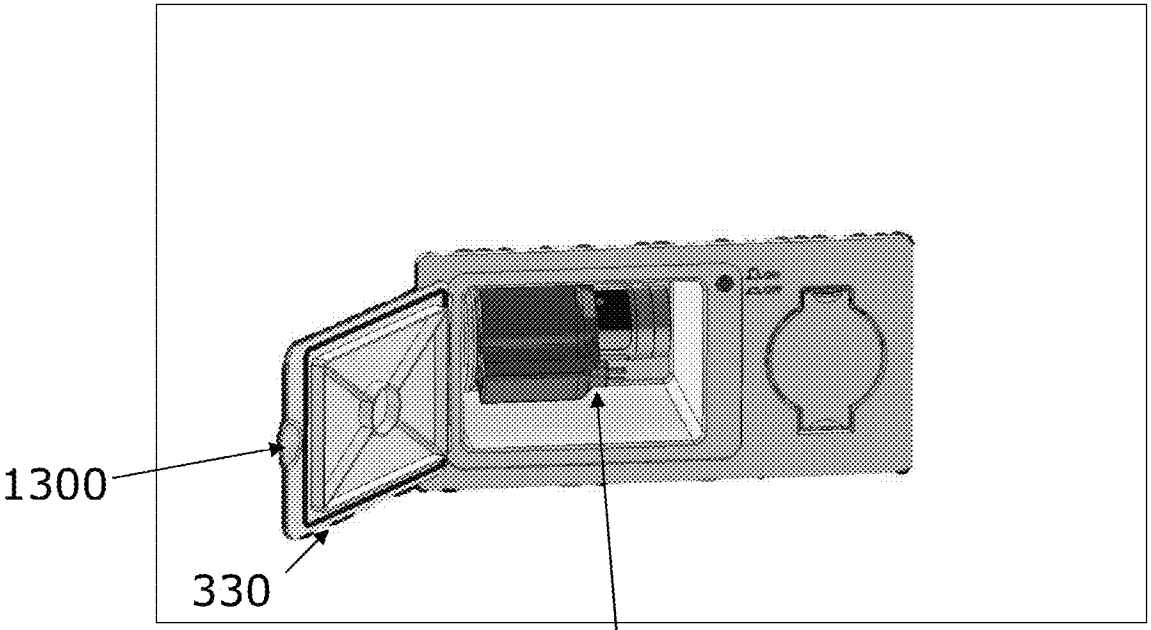
FIG. 15 illustrates the embodiment of the invention shown in FIG. 14 with the vacuum inlet door closed and the hose access door open to reveal the hose cuff according to one embodiment of the invention.
Figure 16:
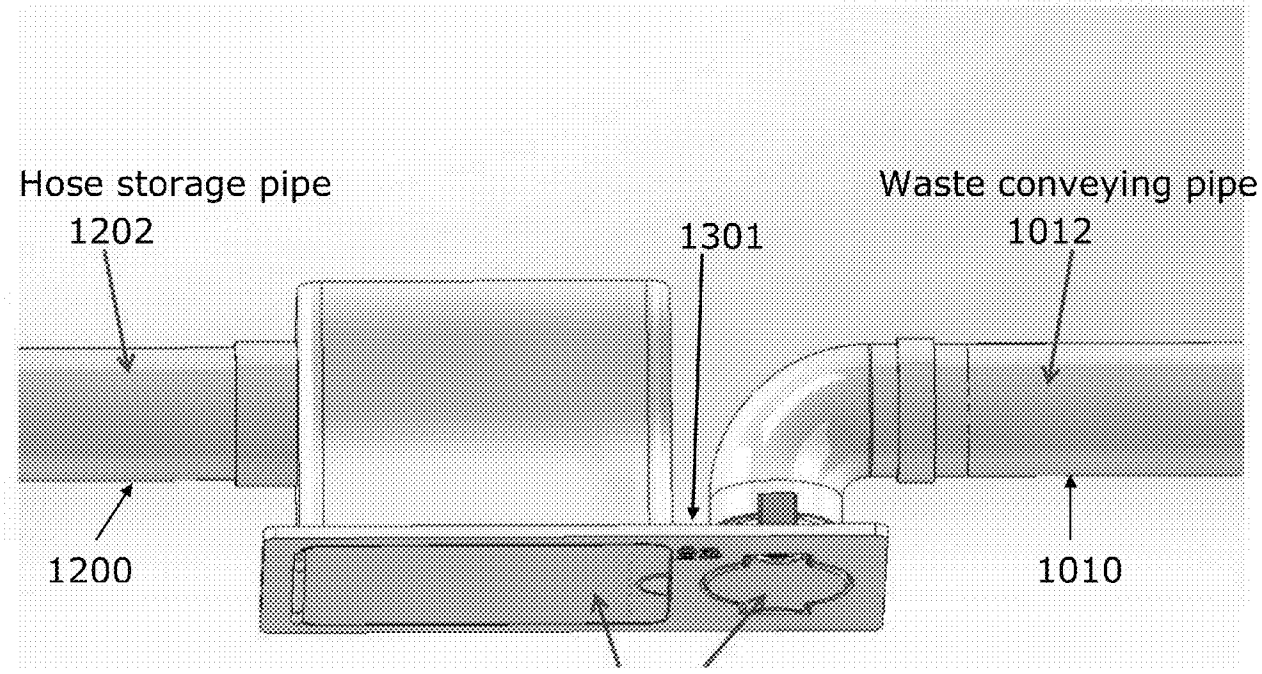
FIG. 16 illustrates a top perspective view with the wall removed and the hose access door and valve inlet door closed of the embodiment shown in FIG. 3 according to one embodiment of the invention.

The hose access door 330, in this embodiment of the vacuum inlet valve 1300, functions similarly to the embodiment 300 discussed above. However, the hose 100 is stored in the hose storage area 1200 which is separate from the waste conveying portion 1010. Also, the hose cuff 110, as illustrated in FIG. 15 where the hose access door 330 is shown in the open position, is in the opposite orientation to that shown in the first embodiment 300 such as in FIG. 3. This is apparent because the hose 100 is now stored in a hose storage area 1200 which is separate from the waste conveying portion 1010. As illustrated in FIG. 16, the waste conveying portion 1010 may constitute a waste conveying pipe 1012 and similarly, the hose storage area 1200 may constitute a hose storage pipe 1202, however, it is understood that other types of arrangements are possible. Furthermore, while the hose storage pipe 1202 is shown as being substantially parallel to the waste conveying pipe 1012, other orientations are also possible. For instance, depending on the arrangement of the vacuum system 10, the hose storage pipe 1202 may be perpendicular to the waste conveying pipe 1012, either going vertically upwards or vertically downwards (not shown), but in either case the hose storage area 1200 would be separate from the waste conveying portion 1010 and the first outlet opening 1301 would be remote from the second outlet opening 1302.

Figure 17:
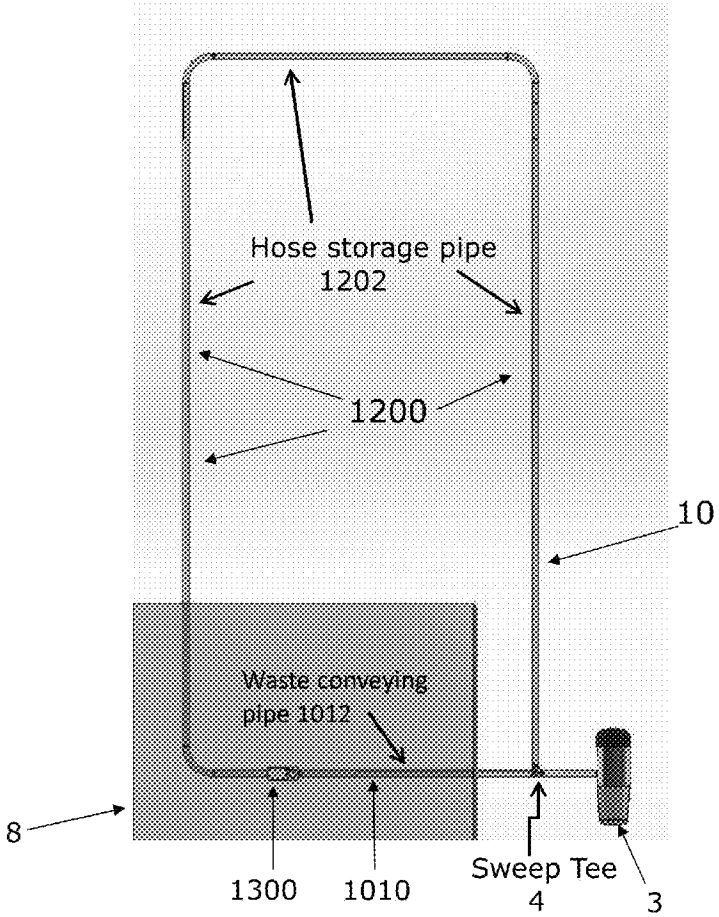
FIG. 17 illustrates the central vacuum system with the waste conveying pipe separate the hose storage pipe according to one embodiment of the invention.

FIG. 17 shows a simplified schematic drawing of the vacuum system 10 with the hose storage pipe 1202 constituting the hose storage area 1200. The waste conveying pipe 1012 constituting the waste conveying portion 1010 is shown being separate from the hose storage area 1200. The vacuum inlet valve 1300 is shown behind the wall 8 and intermediate the waste conveying portion 1010 and hose storage area 1200. As also illustrated in FIG. 17, the system 10 comprises a vacuum source 3 which may have a standard canister 9 having a bag or other receptacle to receive the waste that is entrained in the vacuum during cleaning. As also illustrated in FIG. 17, the hose storage portion 1200 and waste conveying portion 1010 are in vacuum communication with the vacuum source 3 through the sweep tee 4 which is remote from the vacuum inlet valve 1300 such as at a distance greater than the length of the hose 100. In this way, the same vacuum source 3 can provide a vacuum V for the waste conveying portion 1010, to entrain waste during cleaning, as well as the hose storage area 1200, to retract the hose during storage, such that the waste conveying portion 1010 and the hose storage area 1200 are separate from each other but still in vacuum communication.

Figure 19:
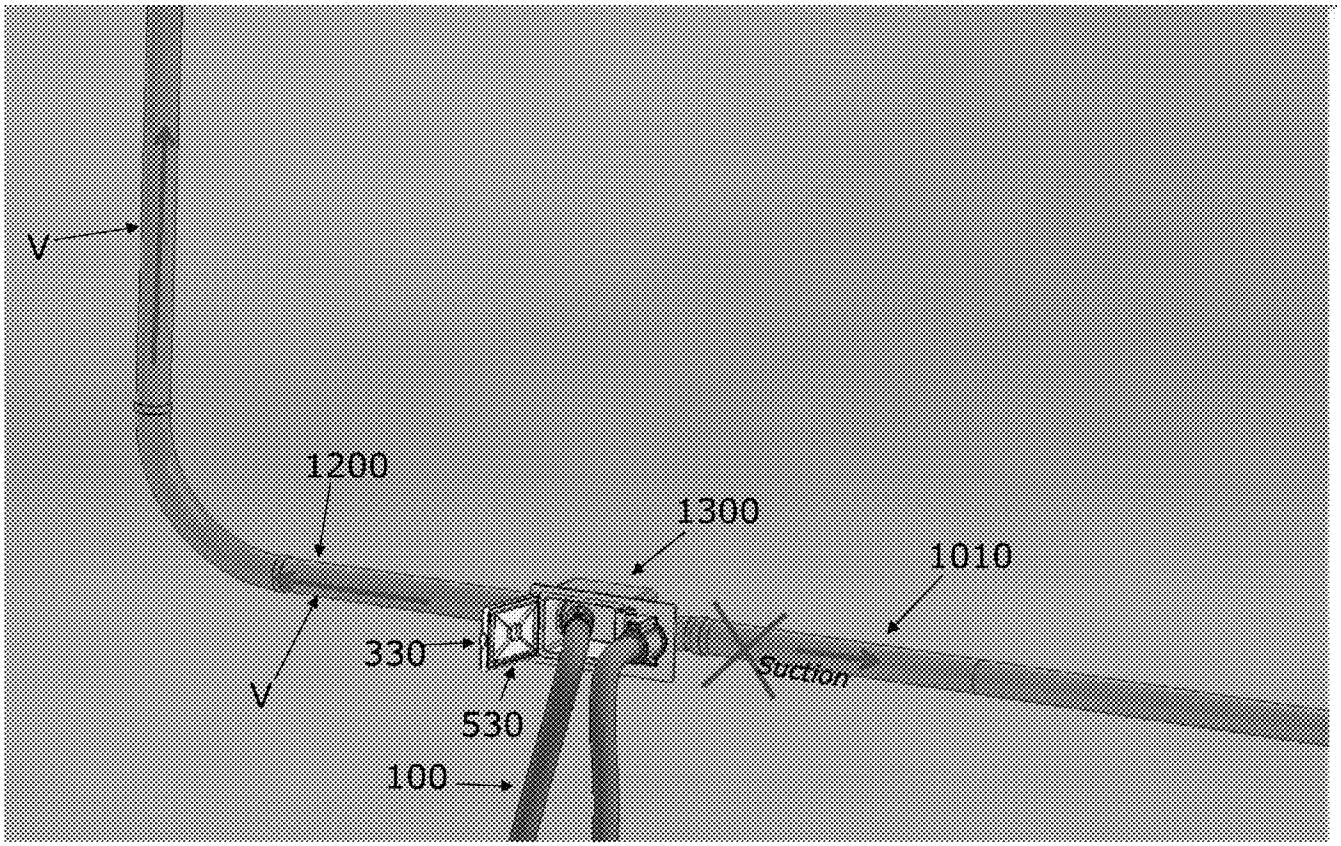
FIG. 19 illustrates the initial storage of the hose into the hose storage area with the second end in the hose access chamber and the hose cuff still connected to the standard dual volt inlet valve according to the embodiment of the invention shown in FIG. 18 with the waste conveying portion separate from the hose storage area.
Figure 20:
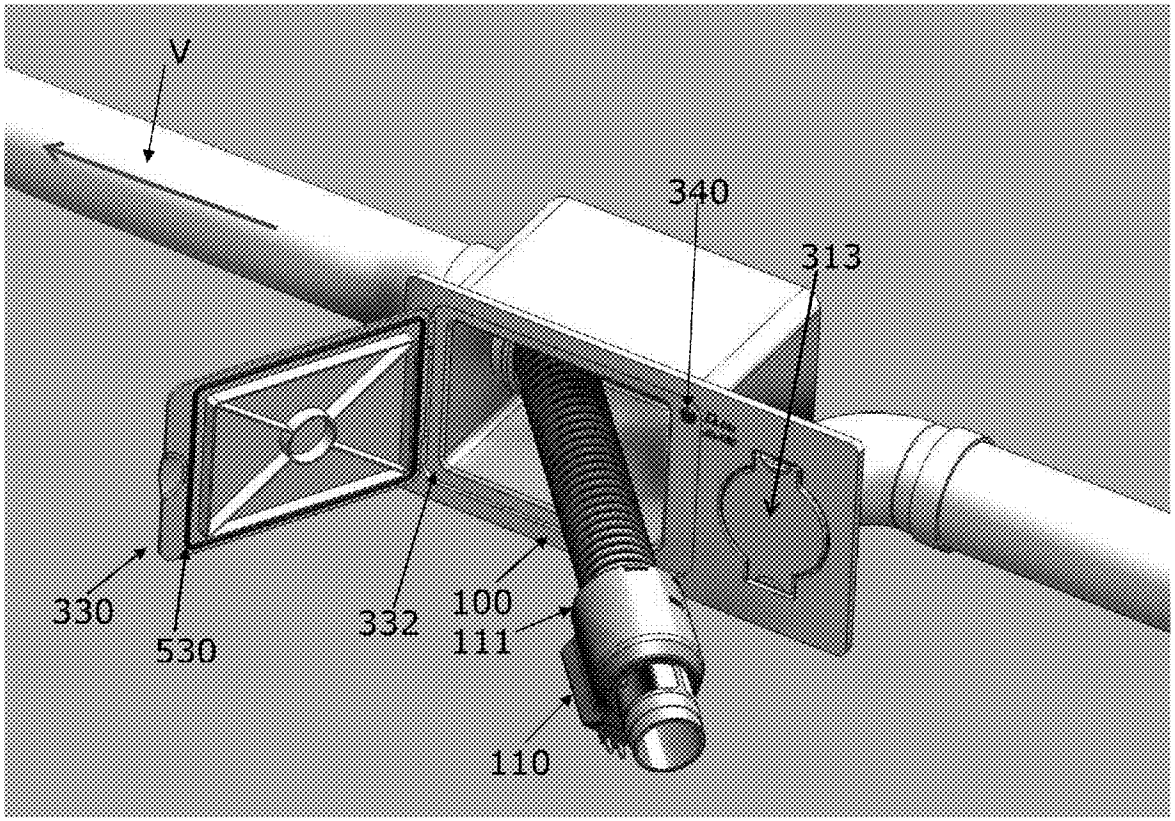
FIG. 20 illustrates an enlarged view of the embodiment shown in FIG. 19 with the second end of the hose in the hose storage area, and, the hose cuff removed from the standard dual volt inlet valve and being stored in the hose cuff compartment according to one embodiment of the invention.

FIGS. 18 and 19 illustrate how the vacuum V generated by the vacuum source 3 is separated by the sweep tee 4 between the hose access area 1200 and the waste conveying portion 1010. In particular, FIG. 18 shows the hose 100 removed from the hose storage area 1200 and the hose access door 330 closed so that the system 10 may be operated as before utilizing the wand 800 connected to the wand connection 120 at the second end 102 of the hose 100. The hose cuff 110 at the first end 101 of the hose 100 is connected to the vacuum connection opening 310 of the standard dual volt inlet valve 301. In this embodiment, the hose 100 is a current carrying hose and therefore the hose cuff 110 and the wand 800 will have a high voltage electrical connection 121 as outlined above to carry high voltage current from the high voltage connection 320 of the standard dual volt inlet valve 301 and a low voltage electrical connection 122 as discussed above.

Because of the hose access door 330 and seal 530, there is no air flow in the hose storage pipe 1202, which constitutes the hose storage area 1200 in this embodiment, while the standard dual volt inlet valve 301 is in use. Therefore, the seal 530 in the hose access door 330 causes a vacuum seal on the hose storage area 1200, which is represented by the "X" in FIG. 18 preventing fluid flow in the hose storage area 1200 even when the standard dual-volt inlet valve 301 is in use. This is to be contrasted with the storage area 200 in the embodiment of the vacuum inlet valve 300 shown above, where there is fluid flow, and also entrained waste in the hose storage area 200, when the standard dual-volt inlet valve 301 is in use.

In the vacuum inlet valve 1300 shown in FIG. 18, during cleaning, dirt and dust will become entrained in the vacuum V created by the vacuum source 3 and will be sucked through the hose 100, the hose cuff 110, the vacuum inlet connection opening 310 of the standard dual volt inlet valve 301 and then through the waste conveying portion 1010 for collection in the canister 9 of the vacuum source 3. As such, no waste, such as dust and dirt, will pass through the hose storage area 1200 in this embodiment. In this way, the hose storage area 1200 will be maintained somewhat cleaner than the waste conveying portion 1010, and thus avoiding waste, such as dust and dirt, coming into contact with the hose 100 during storage.

FIG. 19 illustrates storage of the hose 100 with the vacuum inlet valve 1300. Similar to the above, the second end 102 of the hose 100 is initially manually inserted into the hose access chamber 370 and through the hose access opening 332. The second end 102 is placed near, including possibly into, the hose storage area 1200. The vacuum system 10 is then activated using the manual switch 340 to create a vacuum V in the hose storage area 1200 as shown in FIG. 19. As shown in FIG. 19, a suction will also be created in the waste conveying portion 1010, but because the hose cuff 110 is connected to the vacuum inlet 301, no air will pass through the waste conveying portion 1010, which is represented by the "X" in FIG. 19, because the second end 102 is experiencing a similar vacuum V in the hose storage area 1200. Rather, the vacuum V generated by the system 10 will retract the second end 102 of the hose 100 into the hose storage area 1200. The rear surface 111 of the hose cuff 110 is abutting against the abutment surface 210 to avoid further retraction of the hose 100 into the hose storage area 1200 as discussed above. The door 330 will then be closed creating a vacuum seal so that other vacuum inlet valves (not shown) in the system 10 can be used without degradation of the vacuum. When the hose access door 330 is closed, the manual switch 340 will also be covered to avoid accidental operation of the switch 340 and any unintended activation of the vacuum source 3 of the central vacuum system 10.

Figure 21:
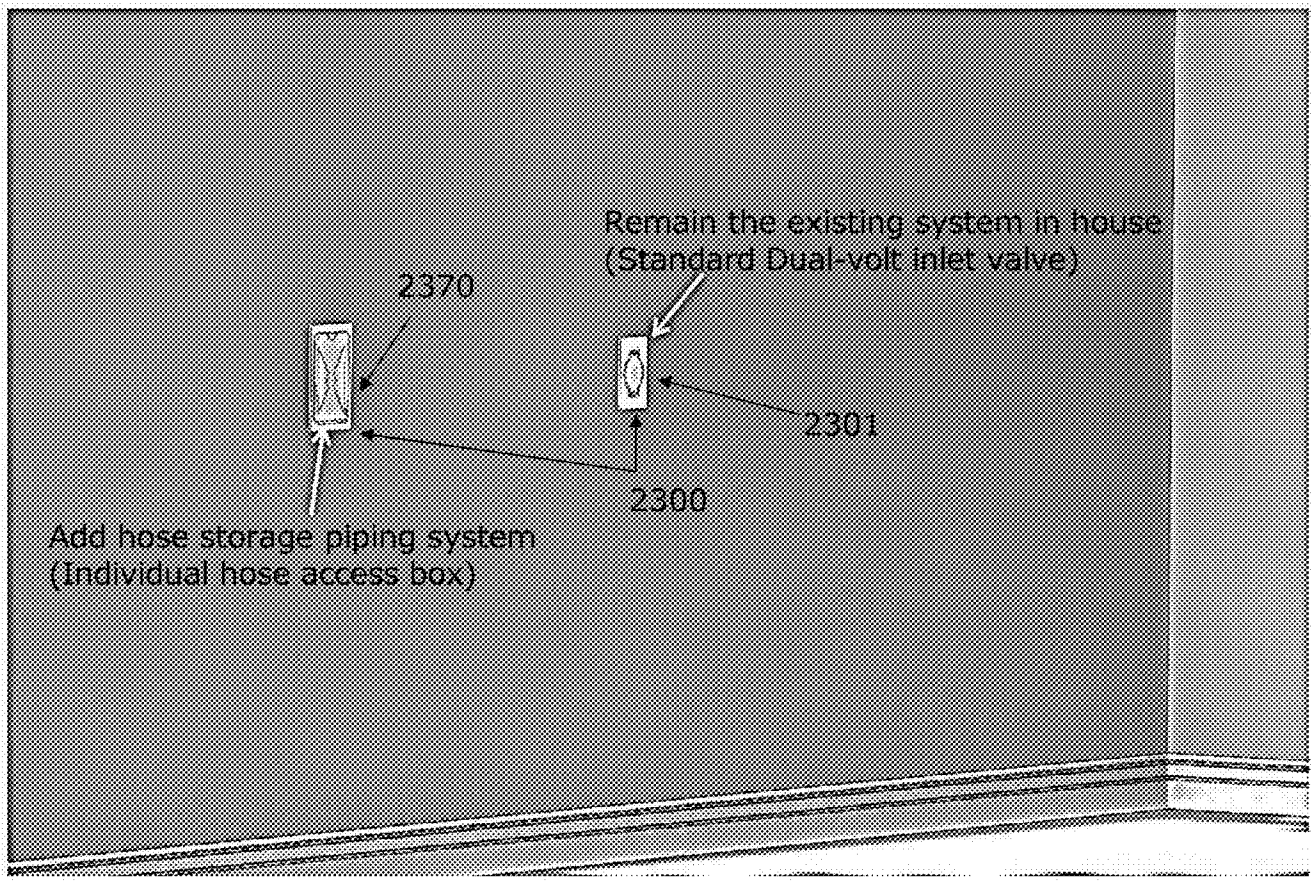
FIG. 21 illustrates a further embodiment of the invention where the hose access chamber is separate from the standard dual volt inlet valve.
Figure 22B:
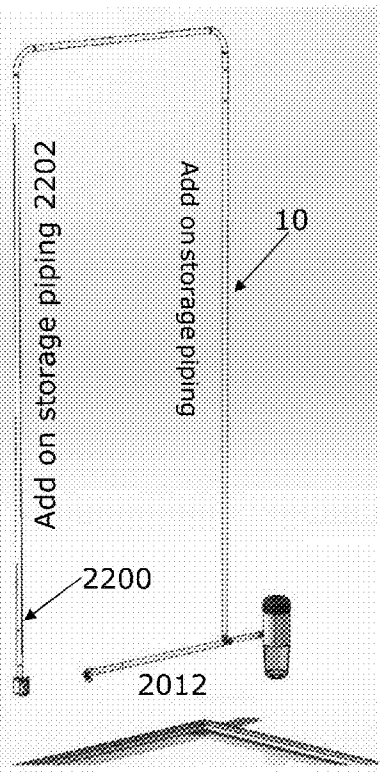
FIGS. 22*a* and 22*b* illustrate a central vacuum system being retrofitted with the hose access chamber shown in FIG. 21 and the wall removed according to one embodiment of the invention.
Figure 22A:
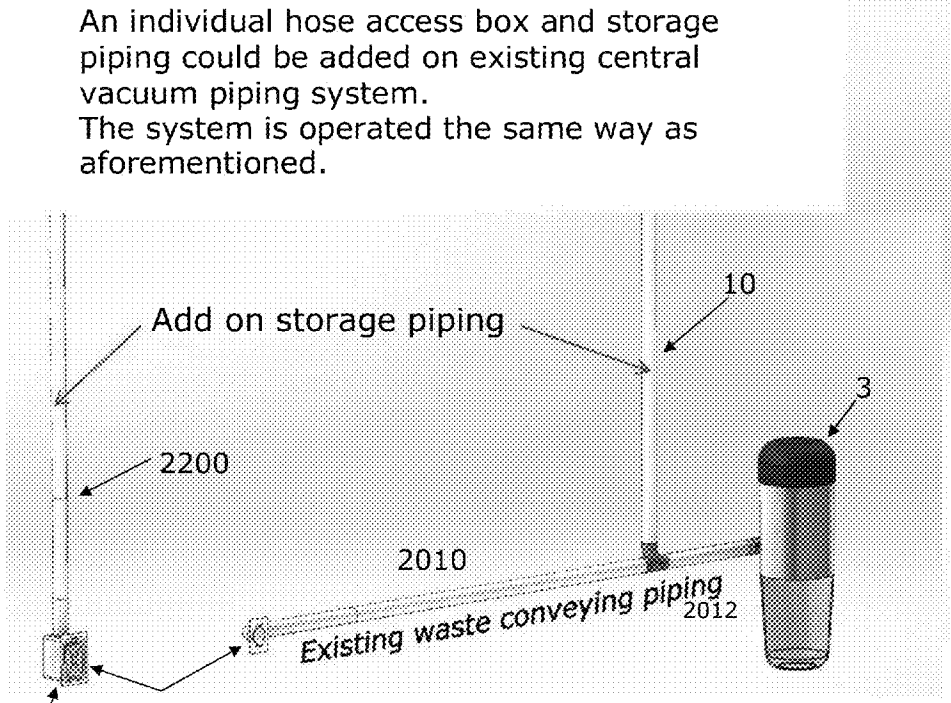

FIGS. 21, 22*a*, 22*b* and 23 show further embodiment of the present invention where the chamber 2370 is shown as being separate from the standard dual volt inlet valve 2301. This embodiment of the present invention relates to a vacuum inlet valve, shown generally by reference numeral 2300, where the hose access chamber 2370 is separate from the standard dual volt inlet valve 2301. As illustrated in FIGS. 22*a* and 22*b*, this can be used in cases where the hose storage area, shown by reference numeral 2200 in FIGS. 22*a* and 22*b*, is installed on existing vacuum system 10 and there is no room for a hose storage area 2200 near the standard dual-volt inlet valve 2301. In this case, the hose storage area 2200 may be retroactively stored onto the existing vacuum system 10. The storage area 2200 may be constituted by an add-on storage piping 2202 in cases where the storage area 2200 does not have another location. The waste conveying portion, in this embodiment illustrated by reference numeral 2010, may be constituted by a waste conveying piping 2012 which in this embodiment may be an existing waste conveying piping 2012, in cases where the vacuum inlet valve 2300 has been retrofitted.

FIG. 23 shows a further embodiment of the hose access chamber 2370 of the vacuum inlet valve shown in FIGS. 21, 22*a* and 22*b*. As shown in FIG. 23, the hose access chamber 2370 is separate from the standard dual volt inlet valve 301. The hose access chamber 2370 has hose cuff compartment 220, a hose storage area opening 202 and the abutment surface 210. As such, the hose access chamber 2370 can store the hose cuff 110 in the hose cuff compartment 220 with the rear surface 111 of the hose cuff 110 abutting against the abutment surface 210 to prevent further retraction of the hose 100 into the hose storage area 2200. Similarly, the door 330 of the hose access chamber 2370 has a seal 530 to create a vacuum seal in the hose cuff compartment 220 in the hose storage area 2200. When the hose access door 330 is closed, a portion 331 will cover the manual switch 340 to prevent accidental activation of the switch 340 while the hose 100 is in the stored position.

To the extent that a patentee may act as its own lexicographer under applicable law, it is hereby further directed that all words appearing in the claims section, except for the above defined words, shall take on their ordinary, plain and accustomed meanings (as generally evidenced, inter alia, by dictionaries and/or technical lexicons), and shall not be considered to be specially defined in this specification. Notwithstanding this limitation on the inference of "special definitions," the specification may be used to evidence the appropriate, ordinary, plain and accustomed meanings (as generally evidenced, inter alia, by dictionaries and/or technical lexicons), in the situation where a word or term used in the claims has more than one pre-established meaning and the specification is helpful in choosing between the alternatives.

It will be understood that, although various features of the invention have been described with respect to one or another of the embodiments of the invention, the various features and embodiments of the invention may be combined or used in conjunction with other features and embodiments of the invention as described and illustrated herein.

Although this disclosure has described and illustrated certain preferred embodiments of the invention, it is to be understood that the invention is not restricted to these particular embodiments. Rather, the invention includes all embodiments, which are functional, electrical or mechanical equivalents of the specific embodiments and features that have been described and illustrated herein.

What is claimed is:

1. A vacuum inlet valve for a central vacuum cleaning system comprising:

a vacuum inlet connection opening in vacuum communication with a hose storage pipe, and, associated with a high voltage connection;

a hose access opening providing access to the hose storage pipe;

a hose access door having a seal to substantially provide a vacuum seal around the hose access opening when closed; and a manually operated switch to activate the central vacuum cleaning system;

wherein a current carrying vacuum hose having a hose cuff for connection to the vacuum inlet connection opening and high voltage connection at a first end and a wand connection at the second end is stored in the hose storage pipe and configured to be completely removed from the hose storage pipe and the vacuum inlet valve by traveling through the hose access opening when the hose access door is open and the vacuum inlet valve and hose storage pipe are fully assembled and operable to be used in order to permit direct connection of the first end to the high voltage connection and the vacuum inlet connection opening and direct connection of the second end to a wand, and, the hose access opening is vacuum sealed when the hose access door is closed to decrease vacuum degradation in the central vacuum cleaning system.

2. The vacuum inlet valve as defined in claim 1 further comprising a hose cuff compartment for storing the hose cuff when the hose is completely retracted into the hose storage pipe, said hose cuff compartment located between the hose storage pipe and the hose access door, and, in vacuum communication with the vacuum inlet connection opening;

wherein, when the hose cuff is completely contained within the hose cuff compartment, the hose access door can close to seal the hose cuff compartment and the hose storage pipe.

3. The vacuum inlet valve as defined in claim 1 further comprising an abutting surface near an opening of the hose storage pipe which abuts against the hose cuff at the first end of the hose when the hose is completely retracted into the storage pipe to prevent further retraction of the hose.

4. The vacuum inlet valve as defined in claim 3 wherein during storage, the second end of the hose is initially manually inserted through the hose access opening while the switch is manually operated to activate the central cleaning system generating a vacuum in the hose storage pipe to retract the hose therein.

5. The vacuum inlet valve as defined in claim 3 wherein, during storage, the hose cuff remains connected to the vacuum inlet connection opening while the switch is manually operated to retract the hose into the hose storage pipe; and wherein once fully retracted, except for the hose cuff, the hose cuff is removed from the vacuum inlet valve and the switch is again manually activated to retract the hose into the storage area until the hose cuff abuts the abutment surface.

6. The vacuum inlet valve as defined in claim 1 wherein the vacuum inlet connection opening is substantially perpendicular to a portion of the hose storage pipe to provide visual confirmation of the hose in the hose storage pipe through the vacuum inlet connection opening.

7. The vacuum inlet valve as defined in claim 6 wherein the vacuum inlet valve is integrally formed having a first outlet opening connected to the vacuum inlet connection opening and a second outlet opening connected to the hose storage pipe wherein the first outlet opening is proximate the second outlet opening.

8. The vacuum inlet valve as defined in claim 1 wherein the vacuum inlet connection opening is connected to a first outlet opening and the hose storage pipe is connected to a second outlet opening different from the first outlet opening and remote therefrom.

9. The vacuum inlet valve as defined in claim 8 wherein the hose access door and the manually operated switch are located remotely from the vacuum inlet connection opening.

10. The vacuum inlet valve as defined in claim 1 wherein a portion of the hose access door overlaps the switch when the door is in the closed position to prevent accidental activation of the switch when the hose access door is closed; and wherein the switch is a push button switch with "non-active" corresponding to a "pushed-in" position such that closing the hose access door de-activates the central vacuum system.

11. A system for storing a hose of a central vacuum cleaning system, said system comprising:

a hose storage pipe;

a vacuum inlet valve having a vacuum inlet connection opening and an associated inlet high voltage connection, and, a hose access door having a seal and providing access to the hose storage pipe, and a manually operated switch to activate the central vacuum cleaning system and generate a vacuum in the hose storage pipe and vacuum inlet connection opening;

a current carrying hose having a first end with a hose cuff for connection to the vacuum inlet connection opening, and, a second end with a wand connection; and wherein, when the hose access door is open, the hose may be stored in the hose storage pipe by manually operating the switch to activate the central vacuum system and generate a vacuum in the hose storage pipe to retract the hose, and, when the hose access door is closed, the seal substantially provides a vacuum seal decreasing vacuum degradation, and the current carrying hose is configured to be completely removed from the hose storage pipe and the vacuum inlet valve by traveling through the hose access opening when the hose access door is open and the vacuum inlet valve and hose storage pipe are fully assembled and operable to be used.

12. The system as defined in claim 11, wherein, to effect storage of the hose in the hose storage pipe, the hose cuff is connected to the vacuum inlet connection opening and the wand connection at the second end of the hose is placed near or inserted into the hose storage pipe while the switch is operated to activate the central vacuum cleaning system generating a vacuum in the hose storage pipe to retract the hose;

once the hose is fully retracted, except for the hose cuff, the hose cuff is removed from the vacuum inlet connection opening and the switch is operated to activate the central vacuum system and completely retract the hose into the hose storage compartment.

13. The system as defined in claim 11 further comprising an abutting surface against which the hose cuff abuts when the hose is completely retracted into the hose storage pipe to prevent further retraction of the hose.

14. The system as defined in claim 13 further comprising a hose cuff compartment for storing the hose cuff when the hose is completely retracted into the hose storage pipe, said hose cuff compartment located between the hose storage pipe and the hose access door, and, in vacuum communication with the vacuum inlet connection opening;

wherein, during storage, the second end of the hose is initially manually inserted through the hose access door into the hose cuff compartment while the switch is manually operated to activate the central cleaning system generating a vacuum in the hose storage pipe to retract the hose therein;

wherein the switch is manually operated until the hose is completely retracted into the storage pipe, with the hose cuff completely contained within the hose cuff compartment and abutting the abutment surface such that the hose access door can close to seal the hose cuff compartment and the hose storage pipe.

15. The system as defined in claim 11 wherein the vacuum inlet connection opening provides visual access to a portion of the hose in the hose storage pipe.

16. The system as defined in claim 11 further comprising:

a waste conveying portion connected to the vacuum inlet connection opening, said waste conveying portion being separate from the hose storage pipe, such that the hose may be retracted into the hose storage pipe without passing through the waste conveying portion; and wherein the waste conveying portion and the hose storage pipe are in vacuum communication such that activating the central vacuum system generates a vacuum in both the waste conveying portion and the hose storage pipe.

17. The system as defined in claim 11 wherein a portion of the hose access door overlaps the switch when the door is in the closed position to prevent accidental activation of the switch when the hose access door is closed; and wherein the switch is a push button switch with "non-active" corresponding to a "pushed-in" position such that closing the hose access door de-activates the central vacuum system.

* * * * *